US011198583B2

(12) United States Patent
Matsuki

(10) Patent No.: US 11,198,583 B2
(45) Date of Patent: Dec. 14, 2021

(54) SHEET DISCHARGE DEVICE, AND IMAGE FORMING SYSTEM

(71) Applicant: Satoru Matsuki, Misato (JP)

(72) Inventor: Satoru Matsuki, Misato (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/786,274

(22) Filed: Feb. 10, 2020

(65) Prior Publication Data

US 2020/0180893 A1 Jun. 11, 2020

Related U.S. Application Data

(63) Continuation of application No. 15/388,391, filed on Dec. 22, 2016, now Pat. No. 10,584,011.

(30) Foreign Application Priority Data

Dec. 24, 2015 (JP) ..... 2015-251293

(51) Int. Cl.

| | |
|---|---|
| ***B65H 33/08*** | (2006.01) |
| ***B65H 29/12*** | (2006.01) |
| ***B65H 31/30*** | (2006.01) |
| ***B65H 29/14*** | (2006.01) |

(Continued)

(52) U.S. Cl.

CPC ..... *B65H 33/08* (2013.01); *B65H 29/125* (2013.01); *B65H 29/145* (2013.01); *B65H 29/58* (2013.01); *B65H 31/24* (2013.01); *B65H 31/3027* (2013.01); *B65H 2301/4212* (2013.01); *B65H 2301/4213* (2013.01); *B65H 2301/42192* (2013.01); *B65H 2403/41* (2013.01); *B65H 2403/942* (2013.01); *B65H 2404/1422* (2013.01); *B65H 2404/1424* (2013.01); *B65H 2404/632* (2013.01); *B65H 2511/30* (2013.01); *B65H 2511/515* (2013.01); *B65H 2801/06* (2013.01)

(58) Field of Classification Search

CPC ..... B65H 2301/4213; B65H 33/08; B65H 2301/42192

See application file for complete search history.

(56) References Cited

U.S. PATENT DOCUMENTS 7,318,584 B2 * 1/2008 Kato ..... B42C 1/125 270/58.08
8,172,224 B2 * 5/2012 Kushida ..... B65H 29/14 271/200

(Continued)

*Primary Examiner* — Jennifer Bahls
(74) *Attorney, Agent, or Firm* — Manabu Kanesaka

(57) ABSTRACT

A sheet discharge apparatus includes a first tray for stacking sheets, and a sheet bundle forming unit that forms a sheet bundle on the first tray. The sheet bundle forming unit forms a first sheet bundle on the first tray, and forms a second sheet bundle on the first sheet bundle to be offset from the first sheet bundle. When forming each of the first sheet bundle and the second sheet bundle on the first tray, the sheet bundle forming unit divides sheets constituting each of the sheet bundles into a plurality of sets and discharges the sheets in a plurality of times for each sheet bundle. A number of sheets included in a first sheet set of the first sheet bundle is set smaller than a number of sheets included in a first sheet set of the second sheet bundle.

7 Claims, 18 Drawing Sheets

(51) Int. Cl.
*B65H 29/58* (2006.01)
*B65H 31/24* (2006.01)

(56) References Cited

U.S. PATENT DOCUMENTS 8,393,607 B2 * 3/2013 Masunari ..... B42C 1/125
270/58.08
8,814,157 B2 * 8/2014 Gamo ..... B65H 31/3027
271/3.02
2012/0205853 A1 * 8/2012 Nakamura ..... G03G 15/6538
270/58.01

* cited by examiner

SHEET DISCHARGE DEVICE, AND IMAGE FORMING SYSTEM

CROSS-REFERENCE TO RELATED APPLICATION

This is a continuation application of Ser. No. 15/388,391 filed on Dec. 22, 2016.

BACKGROUND OF THE INVENTION

Field of the Invention

The present invention relates to a sheet discharge device, and an image forming system, and, more particularly, to a sheet discharge device provided with a first tray on which sheets are stacked and a sheet bundle forming unit that forms a sheet bundle on the first tray, and an image forming system provided with an image forming unit that forms an image on each sheet and a sheet conveying unit.

Description of the Related Art

In the field of an image forming system, there are widely known a sheet discharge device and a sheet post-processing device (finisher) that form a sheet bundle on a stack tray (discharge tray). The device of such a type performs jog sorting as needed when forming sheet bundles on the stack tray without applying binding processing thereto to stack the sheet bundles such that they are offset to one another.

In the jog sorting mode, sheets are discharged one by one onto the stack tray, and then the entire stack tray is moved in a direction crossing a sheet conveying direction every time sheets constituting one sheet bundle are discharged. However, a high torque motor is required in order to move the entire stack tray in the jog sorting mode.

Thus, for example, Patent Document 1 discloses a technology in which when a sheet bundle is formed on a stack tray, a processing tray is used to divide sheets constituting one sheet bundle into a plurality of sets and discharged a plurality of times for each set. Specifically, when the number of sheets is 14, the sheets are divided into sets of 5 (sheets)-5 (sheets)-4 (sheets) for discharge. This technology is advantageous in that aligning property of a sheet bundle stacked on the stack tray is improved and that a high torque motor for moving the entire stack tray is not required.

PRIOR ART DOCUMENT

Patent Document

[Patent Document 1] Japanese Patent No. 3,051,685 (see paragraphs [0081] and [0082])

However, even in the configuration in which the sheets constituting one sheet bundle are divided into a plurality of sets and discharged for each set from the processing tray to the stack tray, when the number of sheets constituting one set is large (5 sheets, in the above example), the position of the lowermost sheet constituting the first one of the plurality of sets that contacts the stack tray may be displaced.

This phenomenon is caused due to the difference between friction coefficients of the sheet and the surface of the stack tray. That is, the more the number of sheets constituting one set is, the higher the friction between the lowermost sheet and the stack tray surface becomes by the weight of the sheets constituting one set. The difference in friction is influenced also by seasons or installation environment of a sheet discharge device or the like. Further, when the friction coefficient is changed with a change in the type of sheets, the same phenomenon is caused also in the lowermost sheet of the sheet bundle discharged first onto the stack tray in one job (e.g., processing of forming a plurality of sheet bundles each composed of a predetermined number of sheets on the stack tray by the jog sorting). Further, the same problem may occur not only in the stack tray but also in a processing tray provided inside the sheet discharge device.

SUMMARY OF THE INVENTION

The present invention has been made in view of the above problem, and the object thereof is to provide a sheet discharge device, and an image forming system.

To solve the above problem, according to a first aspect of the present invention, there is provided a sheet discharge apparatus comprising a first tray for stacking sheets, and a sheet bundle forming unit that forms a sheet bundle on the first tray. The sheet bundle forming unit forms a first sheet bundle on the first tray, and forms a second sheet bundle stacked on the first sheet bundle in a state wherein the second sheet bundle is offset from the first sheet bundle. When forming each of the first sheet bundle and the second sheet bundle on the first tray, the sheet bundle forming unit divides sheets constituting each of the sheet bundles into a plurality of sets and discharges the sheets in a plurality of times for each sheet bundle. A number of sheets included in a first sheet set of the first sheet bundle to be discharged at a first time is set smaller than a number of sheets included in a first sheet set of the second sheet bundle to be discharged at a first time.

In a second aspect of the sheet discharge apparatus, the sheet bundle forming unit has a buffer part that temporarily retains conveyed sheets until the number of the sheets reaches a predetermined number, and a discharge mechanism that discharges the sheets retained in the buffer part onto the first tray.

In a third aspect of the sheet discharge apparatus, the sheet discharge apparatus further comprises a conveying path for sheet conveyance, wherein the buffer part is a second tray for temporarily stacking a sheet conveyed thereto through the conveying path.

In a fourth aspect of the sheet discharge apparatus, the sheet discharge apparatus further comprises a conveying path for sheet conveyance, wherein the buffer part is a diverging path formed so as to diverge from the conveying path.

In a fifth aspect of the sheet discharge apparatus, the sheet discharge apparatus further comprises a conveying path for sheet conveyance, wherein the buffer part is a second tray for temporarily stacking a sheet conveyed thereto through the conveying path, and the discharge mechanism discharges a first sheet of the first sheet bundle conveyed thereto through the conveying path onto the first tray as a sheet divided and discharged for a first time, and discharges a sheet temporarily stacked on the second tray onto the first tray as a second or subsequent sheet.

According to a sixth aspect of the invention, an image forming system comprises an image forming unit that forms an image onto a sheet, a first tray for stacking a sheet on which an image is formed by the image forming unit, and a sheet bundle forming unit that forms a sheet bundle on the first tray.

In the invention, the sheet bundle forming unit forms a first sheet bundle on the first tray, and forms a second sheet bundle stacked on the first sheet bundle in a state wherein the second sheet bundle is offset from the first sheet bundle, when forming each of the first sheet bundle and the second sheet bundle on the first tray, the sheet bundle forming unit divides sheets constituting each of the sheet bundles into a plurality of sets and discharges the sheets in a plurality of times for each sheet bundle. A number of sheets included in a first sheet set of the first sheet bundle to be discharged at a first time is set smaller than a number of sheets included in a first sheet set of the second sheet bundle to be discharged at a first time.

BRIEF DESCRIPTION OF THE DRAWINGS

FIGS. 5A to 5C are explanatory views illustrating operation of first and second flapper guides, in which FIG. 5A illustrates a steady state of the first and second flapper guides, FIG. 5B illustrates a state where the first flapper guide in the steady state is turned in the clockwise direction, and FIG. 5C illustrates a state where the second flapper guide in the steady state is turned in the clockwise direction;

FIGS. 9A to 9C are explanatory views each illustrating a discharge mechanism, in which FIG. 9A illustrates a state of a sheet bundle stacked on the processing tray, FIG. 9B illustrates a state where the sheet bundle is being discharged toward a first tray, and FIG. 9C illustrates a state immediately before the sheet bundle is discharged onto the first tray;

FIGS. 13A to 13C are explanatory views each illustrating operation of a discharge mechanism when the first sheet set is discharged to form a first sheet bundle on the first tray, in which FIG. 13A illustrates a state immediately before discharge, FIG. 13B illustrates a state where the discharge is being performed, and FIG. 13C illustrates a state where the discharge is completed;

FIGS. 14A to 14C are explanatory views each illustrating operation of a discharge mechanism when second sheet set is discharged to form the first sheet bundle on the first tray, in which FIG. 14A illustrates a state immediately before discharge, FIG. 14B illustrates a state where the discharge is being performed, and FIG. 14C illustrates a state where the discharge is completed;

FIGS. 16A to 16C each illustrate an operation state in the dividing processing performed when forming the first sheet bundle on the first tray in the second embodiment, in which FIGS. 16A to 16C illustrate first to third phases in order;

FIGS. 17A to 17C each illustrate an operation state in the dividing processing performed when forming the first sheet bundle on the first tray in the second embodiment, in which FIGS. 17A to 17C illustrate fourth to sixth phases in order;

FIGS. 18A to 18C each illustrate an operation state in the dividing processing performed when forming the first sheet bundle on the first tray in the second embodiment, in which FIG. 18A illustrates the same operation state as that illustrated in FIG. 17A (fourth phase) and FIGS. 18B and 18C illustrate seventh and eighth phases in order;

FIGS. 19A to 19C each illustrate a discharge operation of the first sheet set when forming the first sheet bundle on the first tray in a third embodiment, in which FIGS. 19A to 19C illustrate first to third phases in order; and FIGS. 20A to 20C each illustrate a discharge operation of the second or subsequent sheet set when forming the first sheet bundle on the first tray in the third embodiment, in which FIGS. 20A to 20C illustrate first to third phases in order.

DESCRIPTION OF THE PREFERRED EMBODIMENTS

First Embodiment

Hereinafter, a first embodiment of an image forming system to which the present invention can be applied will be described with reference to the drawings. The image forming system according to the present embodiment includes an image forming device A that forms an image on a sheet and a sheet post-processing device B that applies post-processing to the image-formed sheet.

<Configuration>

[Image Forming Device]

1. Mechanism Part

Figure 1:
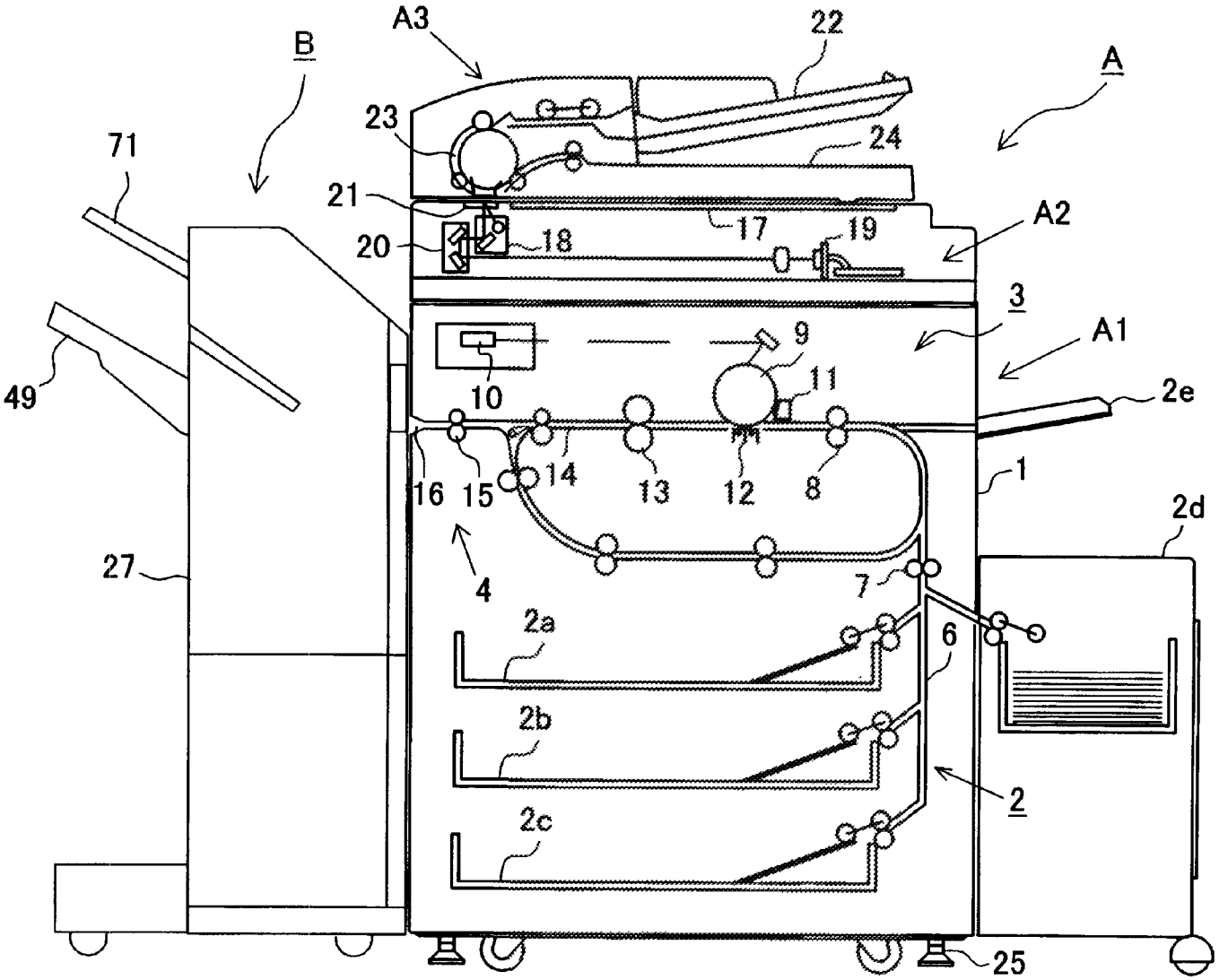
FIG. 1 is a front view of an image forming system according to a first embodiment to which the present invention can be applied.

As illustrated in FIG. 1, the image forming device A includes an image forming unit A1, a scanner unit A2, and a feeder unit A3. In the image forming unit A1, a device housing 1 has mounting legs 25 for installation on an installation surface (e.g., floor surface). The device housing 1 incorporates therein a sheet feed section 2, an image forming section 3, and a sheet discharge section 4. The image forming unit A1 adopts an electrostatic printing mechanism.

The sheet feed section 2 includes cassettes 2*a* to 2*c* for housing sheets of different sizes and delivers a sheet of a specified size to a sheet feed path 6. To this end, the cassettes 2*a* to 2*c* are detachably mounted in the device housing 1, and each cassette incorporates a separation mechanism for separating sheets from one another and a pickup roller for delivering the sheets. In the sheet feed path 6, a conveying roller 7 for feeding a sheet supplied from any of the cassettes 2*a* to 2*c* to a downstream side are provided. Further, a resist roller pair 8 for aligning the front ends of the sheets is provided at the end of the sheet feed path 6.

The sheet feed path 6 is connected with a large capacity cassette 2*d* and a manual feed tray 2*e*. The large capacity cassette 2*d* is configured to accommodate sheets of a size to be consumed heavily as an option unit. The manual feed tray 2*e* is configured to be able to feed a special sheet such as a thick sheet, a coating sheet, or a film sheet for which separation feeding is difficult.

The image forming section 3 has a photoreceptor 9 such as a drum or a belt, and around the photoreceptor 9, a light emitter 10 for irradiating the photoreceptor 9 with a beam according to image data, a developing device 11 (developer), and a cleaner (not illustrated). The illustrated image forming section 3 adopts a monochrome printing mechanism, in which a latent image is optically formed on the photoreceptor 9 by the light emitter 10, and toner ink is forced to adhere to the latent image by the developing device 11.

Then, a sheet is fed to the image forming section 3 from the sheet feed path 6 in accordance with a timing of image formation onto the photoreceptor 9, and an image on the photoreceptor 9 is transferred onto the sheet by a transfer charger 12, followed by fixing of the image by a fixing unit (roller) 13 disposed in a sheet discharge path 14. The sheet discharge path 14 is provided with a sheet discharge roller 15 and a sheet discharge port 16 and conveys a sheet to the sheet post-processing device B to be described later.

The scanner unit A2 includes a platen 17 on which a document is placed, a carriage 18 reciprocated along the platen 17, a light source mounted on the carriage 18, a reduction optical system 20 (combination of mirrors and lenses) that guides a reflected light from the document placed on the platen 17 to a photoelectric conversion section 19, and a traveling platen 21. The photoelectric conversion section 19 outputs photoelectric-converted image data to a memory (see reference numeral 96 in FIG. 10) of a controller. The traveling platen 21 is used when a sheet is conveyed by the feeder unit A3. An image on a sheet being conveyed by the feeder unit A3 is read by the photoelectric conversion section 19 through the carriage 18 and the reduction optical system 20 disposed at a predetermined reading position.

The feeder unit A3 includes a sheet supply tray 22, a sheet feed path 23 for guiding a sheet delivered from the sheet supply tray 22 to the traveling platen 21, and a sheet discharge tray 24 for accommodating a document read through the traveling platen 21.

The image forming device A has a touch panel (not illustrated) capable of displaying a status of the image forming device A and detecting specification (input) of an operator-desired sheet size, a sheet cassette to be used for sheet supply, the number of copies, and the like. The image forming unit A1 is not limited to the above-mentioned electrostatic printing mechanism, but may adopt a printing mechanism such as an offset printing mechanism, an inkjet printing mechanism, or an ink-ribbon transfer printing mechanism (heat transfer ribbon printing, sublimation ribbon printing, etc.).

2. Controller

The image forming device A has a controller (referred to as "main body controller" in order to distinguish it from a controller of the sheet post-processing device B) that controls the entire operation of the image forming device A and communicates with the controller of the sheet post-processing device B.

Figure 10:
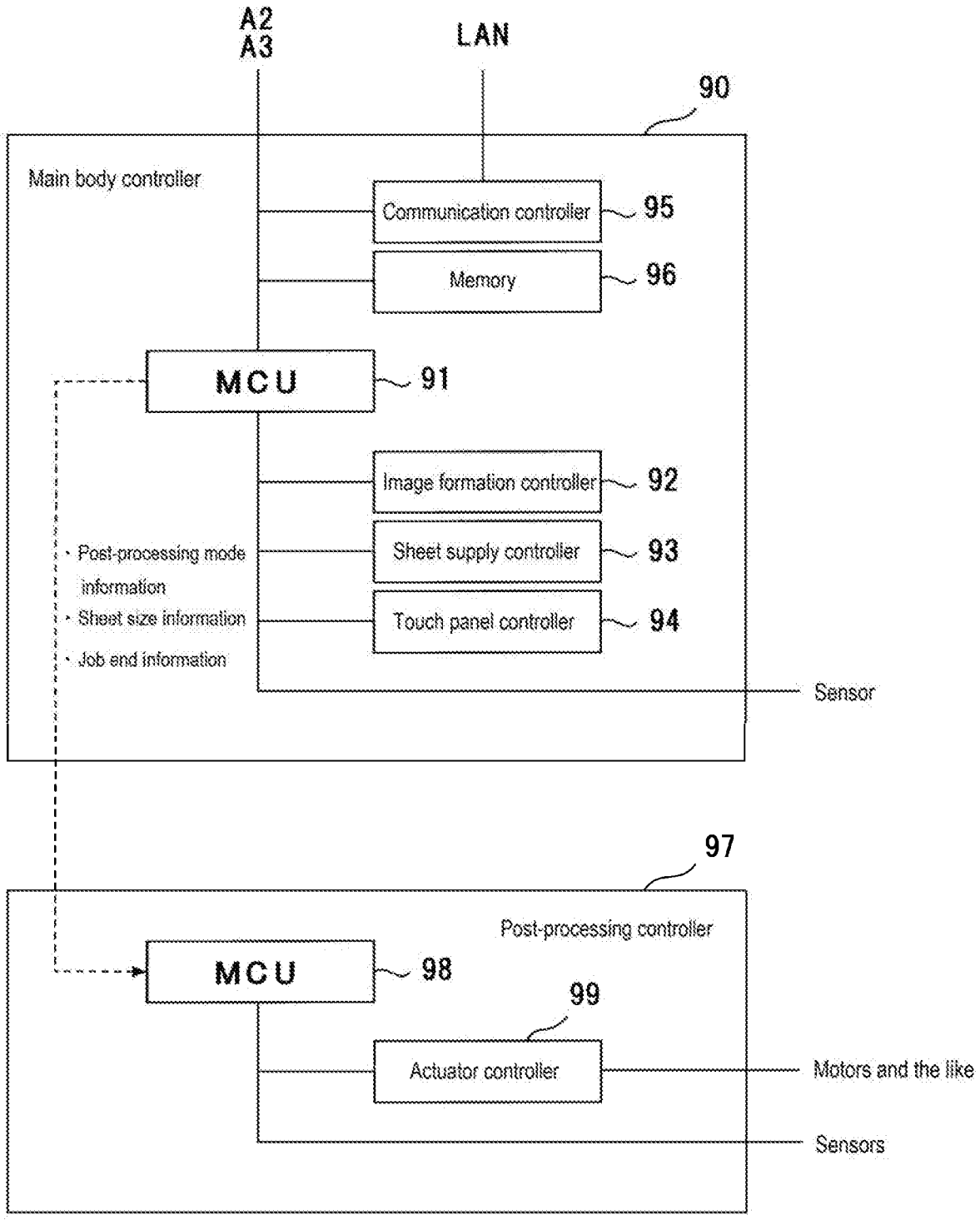
FIG. 10 is a block diagram illustrating a controller of the image forming system.

As illustrated in FIG. 10, the main body controller 90 has an MCU 91 that incorporates a CPU, a ROM, a RAM, and the like. The MCU 91 is connected to an image formation controller 92 that controls operation of the image forming section 3, a sheet supply controller 93 that controls operation of the sheet feed section 2, and a touch panel controller 94 that controls the above-mentioned touch panel.

The MCU 91 is connected to a plurality of sensors provided in the sheet feed path 6, the sheet discharge path 14, and a duplex path that connects the sheet feed path 6 and the sheet discharge path 14 so as to form an image on both sides of a sheet. The MCU 91 is further connected to a communication controller 95 enabling LAN connection and a large capacity memory 96 functioning as a buffer and to the above-mentioned scanner unit A2 and feeder unit A3 through a non-illustrated interface.

[Sheet Post-Processing Device]

1. Mechanism Part

Figure 2:
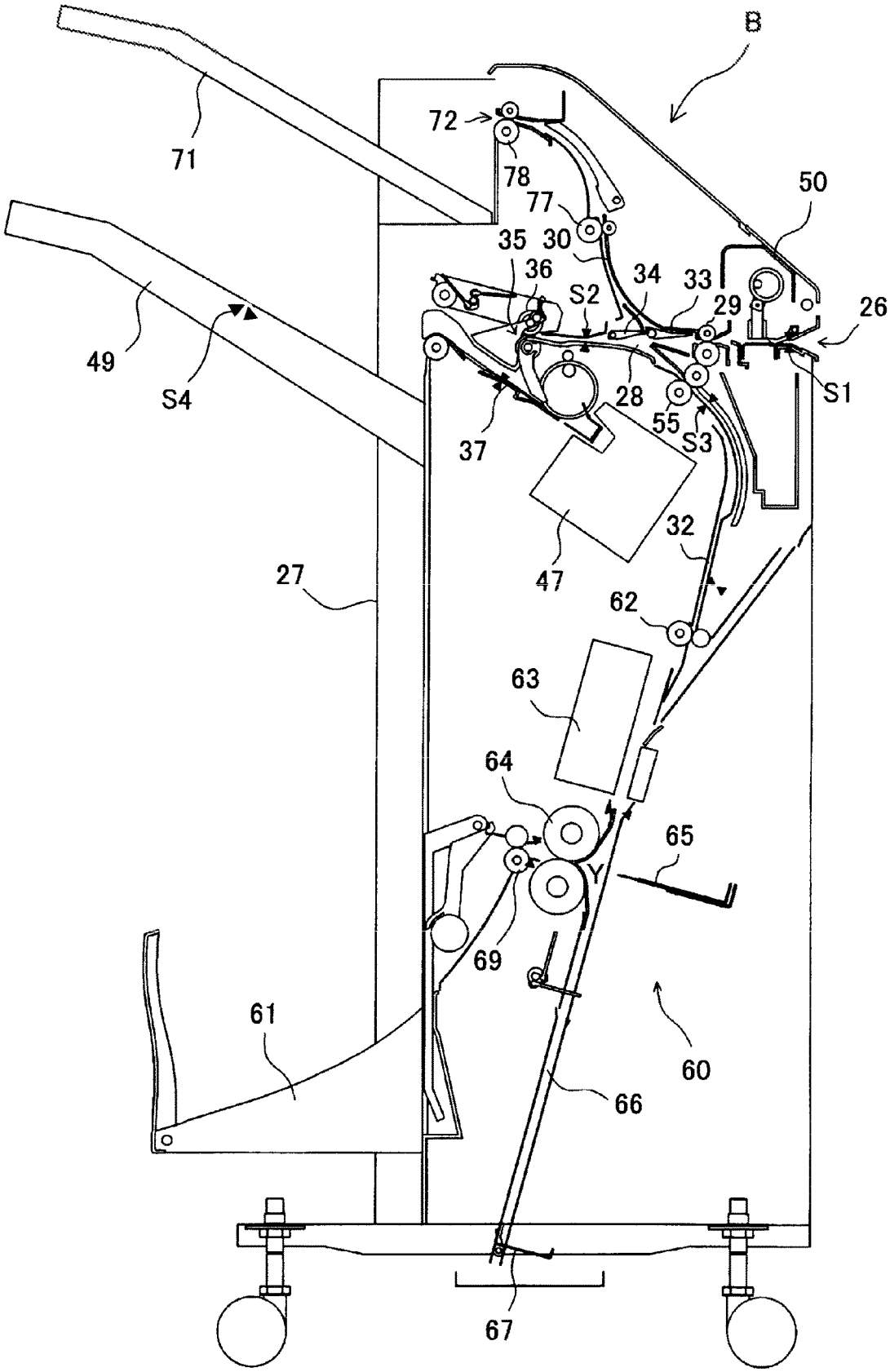
FIG. 2 is a front view of a sheet post-processing device constituting the image forming system according to the first embodiment.

As illustrated in FIGS. 1 and 2, in the sheet post-processing device B, a device housing 27 has mounting legs for installation on an installation surface, whereby the sheet post-processing device B has substantially the same height dimension as the image forming device A positioned upstream thereof. Further, a carry-in port 26 of the sheet post-processing device B is formed so as to be connected to the sheet discharge port 16 of the image forming device A.

As illustrated in FIG. 2, the sheet post-processing device B has a third stack tray (hereinafter, abbreviated as "third tray") 71, a first stack tray (hereinafter, abbreviated as "first tray") 49, and a second stack tray (hereinafter, abbreviated as "second tray") 61 in this order from the top. The above trays 71, 49, and 61 are formed so as to protrude from the device housing 27. The first tray 49 incorporates a reflective type fourth sensor S4 constituted of a light-emitting element and a light-receiving element. The sensor S4 detects the presence/absence of a sheet on the first tray 49.

(1) Sheet Conveying Path

The sheet post-processing device B has a linear sheet carry-in path 28 that crosses the device housing 27 in substantially the horizontal direction. The sheet carry-in path 28 serves as a fundamental path of the sheet conveying path. The sheet carry-in path 28 has the above-mentioned carry-in port 26 at one end thereof and a sheet discharge port 35 at the other end thereof.

Figure 4:
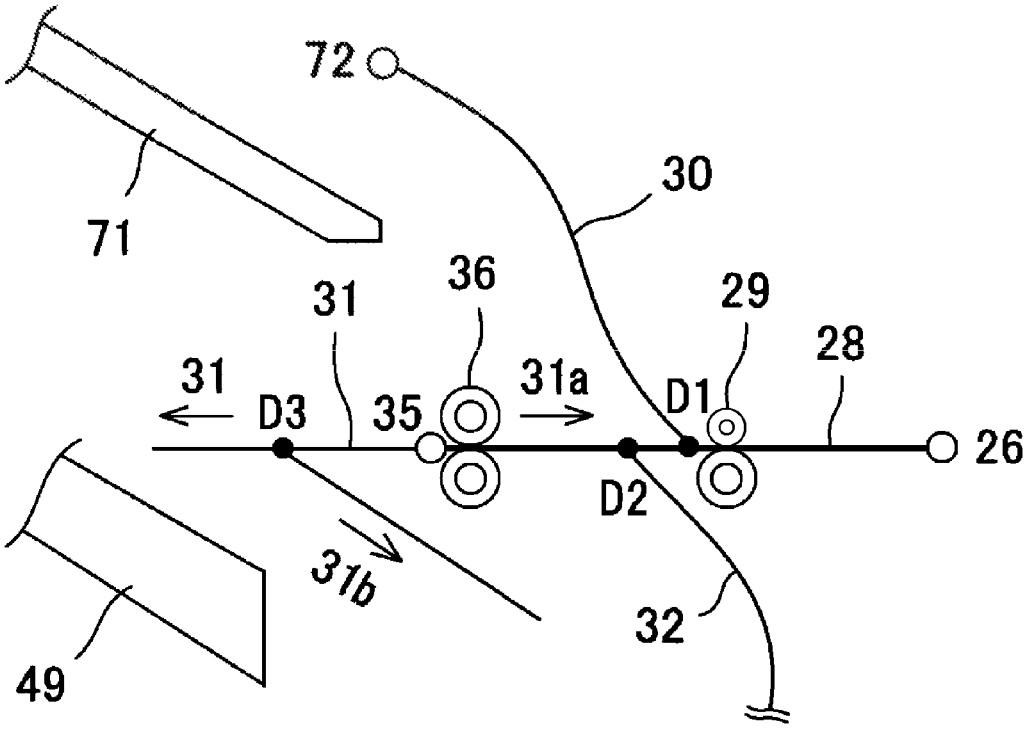
FIG. 4 is an explanatory view schematically illustrating sheet conveying paths of the sheet post-processing device.

FIG. 4 schematically illustrates the sheet conveying path. In FIG. 4, the sheet carry-in path 28 is represented by the thick line. A carry-in roller 29 for carrying a sheet in the sheet post-processing device B is disposed in the vicinity of the carry-in port 26, and a sheet discharge roller 36 capable of being normally and reversely rotated is disposed upstream of the sheet discharge port 35.

The sheet carry-in path 28 has a first diverging point D1 positioned downstream of the carry-in roller 29, and a third conveying path 30 diverges from the sheet carry-in path 28 with the first diverging point D1 as a starting point. The third conveying path 30 has a sheet discharge port 72 at its end, and a sheet is discharged onto the third tray 71 through the sheet discharge port 72. Further, the sheet carry-in path 28 has a second diverging point D2 positioned downstream of the first diverging point D1, and a second conveying path 32 diverges from the sheet carry-in path 28 with the second diverging point D2 as a starting point.

Further, a first conveying path 31 is formed on the extension of the sheet discharge port 35 of the sheet carry-in path 28. The first conveying path 31 is a path for further conveying a sheet conveyed on the sheet carry-in path 28 to the first tray 49 side. As described above, the sheet discharge roller 36 is capable of being normally and reversely rotated. Thus, normally driving the sheet discharge roller 36 enables a sheet to be conveyed to the first tray 49 side through the first conveying path 31, and reversely rotating the sheet discharge roller 36 enables a sheet to be switchback-conveyed such that the rear end of the sheet is reversely conveyed to the second diverging point D2 of the sheet carry-in path 28. Further, the first conveying path 31 has a third diverging point D3 at a position corresponding to the tray side end portion of the device housing 27, a second switchback path 31*b* obliquely diverges from the first conveying path 31 with the diverging point D3 as a starting point.

In FIG. 4, to make first and second switchback paths 31*a* and 31*b* obvious, a path that conveys a sheet to the first tray 49 is illustrated as the first conveying path 31, a path that switchback conveys a sheet is illustrated as the first switchback path 31*a*, and a path that switchback conveys a sheet through the third diverging point D3 is illustrated as the second switchback path 31*b* (the same is applied to FIG. 3 and the like); however, a part of the first switchback path 31*a* overlaps the sheet carry-in path 28, and the second switchback path 31*b* is integrated with the first conveying path 31. The above-mentioned second diverging point D2 is provided at the end of the first switchback path 31*a*.

As described above, by disposing the sheet carry-in path 28 and the first conveying path 31 in substantially the horizontal direction and by disposing the third conveying path 30 and the second conveying path 32 in substantially the vertical direction, slimming of the device can be achieved.

The sheet carry-in path 28 and first to third conveying paths 31, 32, and 30 each have various members therealong. Hereinafter, the members arranged on the respective paths will be described.

(2) Sheet Carry-In Path 28

Figure 3:
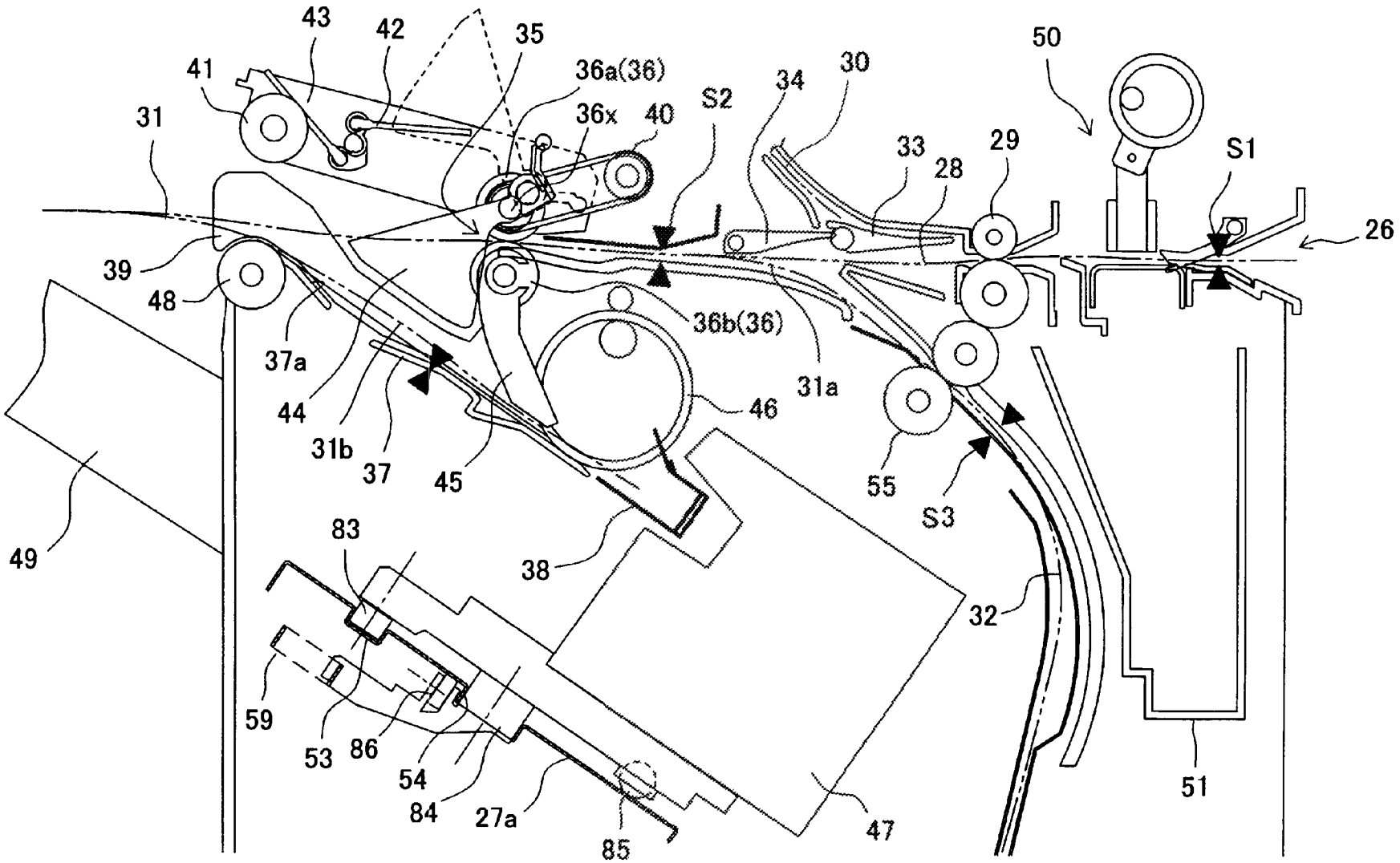
FIG. 3 is a front view illustrating the main part of the sheet post-processing device in an enlarged manner.

As illustrated in FIG. 3, on the sheet carry-in path 28, a transmissive type first sensor S1 constituted of a light-emitting element and a light-receiving element is disposed downstream of the carry-in port 26. Further, on the sheet carry-in path 28, a punch unit 50 is disposed between the first sensor S1 and the carry-in roller 29. The punch unit 50 punches, when a non-illustrated punch motor is driven, a hole in the rear end portion of a carried-in sheet.

The punch unit 50 has, at the lower portion thereof, a rack (not illustrated). By rotating a pinion (not illustrated) meshing with the rack by a non-illustrated unit moving motor, the punch unit 50 can be moved in the direction perpendicular to the sheet carry-in path 28, thereby allowing punching processing to be performed at an appropriate position according to a sheet size. In order to enhance position accuracy of the punch hole, punching processing may be performed after detecting the side end edge of a sheet using a sensor to figure out a punch position. On the side opposite to the punch unit 50 across the sheet carry-in path 28, a chip box 51 that receives punch chips generated in the punching processing by the punch unit 50 is detachably attached to the device housing 27.

A first flapper guide (hereinafter, abbreviated as "first flapper") 33 and a second flapper guide (hereinafter, abbreviated as "second flapper") 34 are disposed at the above-mentioned first and second diverging points D1 and D2, respectively. The first and second flappers 33 and 34 each have a configuration in which the leading end thereof is turned about a support shaft thereof to enable change (selection) of the sheet conveying direction, and the respective support shafts thereof are each connected to an electromagnetic solenoid having a plunger that can be advanced and retreated. A mini motor may be used as a drive source for the first and second flappers 33 and 34.

Figure 5A:
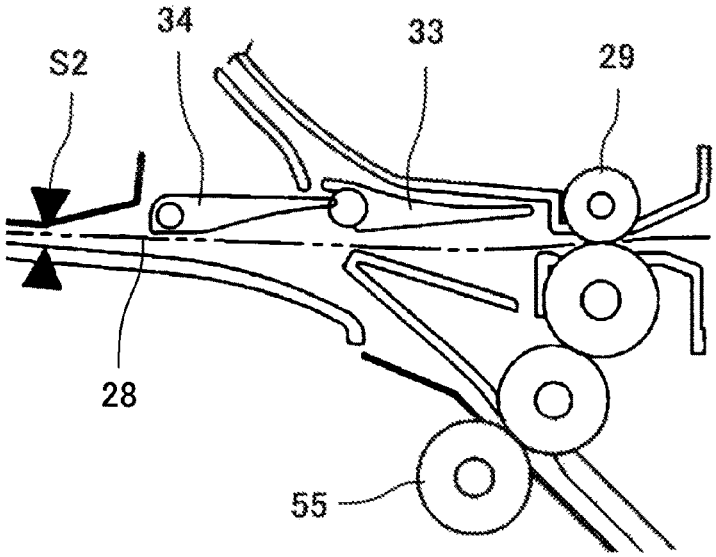
Figure 5B:
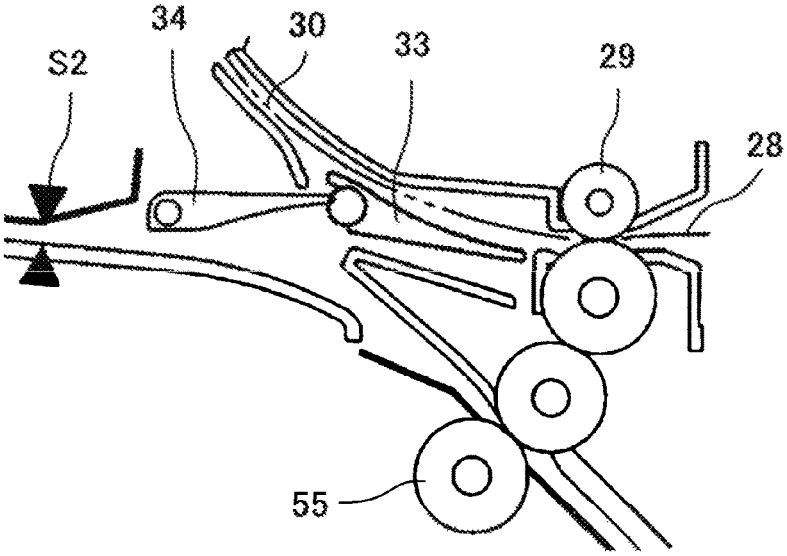
Figure 5C:
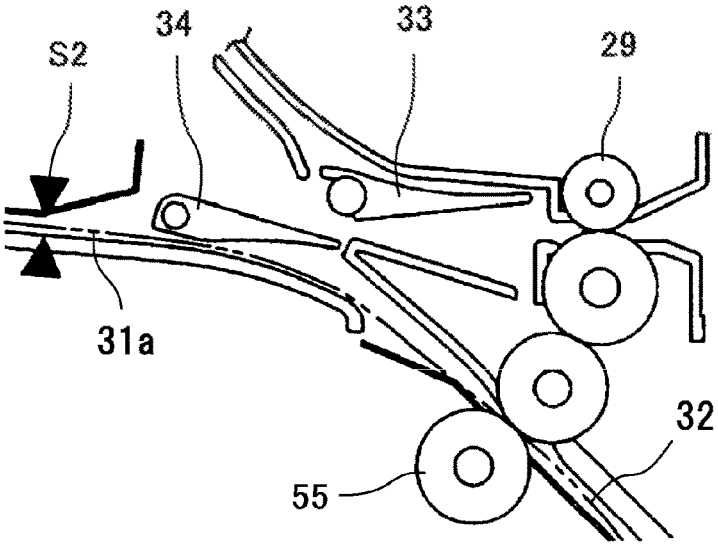

FIG. 5A illustrates a steady state (off-state) in which the electromagnetic solenoids that drive the respective first and second flappers 33 and 34 are not energized. In this state, a sheet is conveyed toward the sheet discharge port 35 along the sheet carry-in path 28. On the other hand, as illustrated in FIG. 5B, when the electromagnetic solenoid that drives the first flapper 33 is energized (is turned OFF), the first flapper 33 is turned in the clockwise direction. As a result, a sheet is guided from the sheet carry-in path 28 to the third conveying path 30. At this time, the electromagnetic solenoid that drives the second flapper 34 remains in an off-state. Further, as illustrated in FIG. 5C, when the electromagnetic solenoid that drives the second flapper 34 is energized (is turned ON), the second flapper 34 is turned in the clockwise direction. As a result, a sheet is guided from the first switchback path 31*a* (sheet carry-in path 28) to the second conveying path 32. At this time, the electromagnetic solenoid that drives the first flapper 33 remains in an off-state.

As illustrated in FIG. 3, a transmissive type second sensor S2 constituted of a light-emitting element and a light-receiving element is disposed downstream of the second flapper 34, and the above-mentioned sheet discharge roller 36 is disposed downstream of the second sensor S2.

The above-mentioned carry-in roller 29 is constituted of a drive roller (upper side of FIG. 3) and a driven roller (lower side of FIG. 3) brought into pressure contact with the drive roller, and a rotary driving force of a non-illustrated first conveying motor (stepping motor) is transmitted to the drive roller through a gear. The sheet discharge roller 36 is constituted of a pair of drive rollers 36*a* and 36*b*, and a rotary driving force of a non-illustrated reversible second conveying motor (stepping motor) is transmitted to the pair of drive rollers 36*a* and 36*b* through a gear.

(3) First Conveying Path 31 (and Second Switchback Path 31*b*)

As illustrated in FIG. 3, at the above-mentioned third diverging point D3, a driven roller 48 and a lifting roller 41 capable of being normally and reversely rotated are disposed. The lifting roller 41 can be moved vertically between an operating position at which it is brought into pressure contact with the driven roller 48 and a standby position at which it is separated from the driven roller 48. The lifting roller 41 is located at the standby position when a sheet is conveyed along the sheet carry-in path 28 and first switchback path 31*a* (see the arrow 31*a* of FIG. 4); while it is located at the operating position when a sheet is discharged onto the first tray 49 or conveyed along the second switchback path 31*b* (see the arrow 31*b* of FIG. 4). The lifting roller 41 and the driven roller 48 have a function of performing sheet conveyance or sheet bundle reverse conveyance on the second switchback path 31*b*. This point will be described later (see (3-1) and (3-4)).

On the second switchback path 31*b*, a processing tray 37 on which sheets are temporarily stacked is disposed. The processing tray 37 functions as a buffer that temporarily retains a sheet conveyed through the sheet carry-in path 28 (first conveying path 31) before discharging it onto the first tray 49. A stapler unit 47 that applies binding processing to a sheet bundle is disposed at one side (downstream side) of the processing tray 37. As described above, the second switchback path 31*b* is inclined, so that the processing tray 37 and the stapler unit 47 disposed on the second switchback path 31*b* are also inclined. As a result, a step (drop) is formed between the sheet discharge port 35 of the sheet carry-in path 28 and the processing tray 37.

The processing tray 37 bridge supports a sheet fed through the sheet discharge port 35 between itself and the first tray 49 disposed downstream of the processing tray 37. In other words, the sheet fed from the sheet discharge port 35 is supported with the leading end thereof placed on the first tray 49 or the topmost sheet of a sheet bundle on the first tray 49 and with the rear end thereof placed on the processing tray 37.

(3-1) Sheet Carry-in Mechanism

Since the step is formed between the sheet discharge port 35 and the processing tray 37, a sheet carry-in mechanism for carrying a sheet into the processing tray 37 is provided on the first conveying path 31 (and the second switchback path 31*b*).

The sheet carry-in mechanism includes the lifting roller 41 that is brought into pressure contact with the driven roller 48 at the operating position as described above to convey a sheet on the second switchback path 31*b* toward the processing tray 37 (regulating member 38) side, a paddle rotating body 42 that is rotated so as to transfer a sheet toward the second switchback path 31*b*, a sheet guide member 44 that guides a sheet to the processing tray 37 side, a sheet pressing member 45 that presses the upper surface of a sheet, and a raking rotating body 46 that conveys a sheet toward the processing tray 37 side.

Further, a swinging bracket 43 that can be swung about a rotary shaft 36*x* (the roller shaft of the sheet discharge roller 36*a*) axially supported by a device frame is provided. The rotary axes of the respective lifting roller 41 and paddle rotating body 42 are axially supported by the swinging bracket 43. When a drive force from a non-illustrated lifting motor is transmitted to the swinging bracket 43, the lifting roller 41 and the paddle rotating body 42 mounted to the swinging bracket 43 are vertically moved between the above-mentioned standby position and operating position.

A drive force from a non-illustrated second conveying motor is transmitted to the lifting roller 41 and the paddle rotating body 42, whereby the lifting roller 41 is normally/reversely rotated, and the paddle rotating body 42 is reversely rotated. That is, the lifting roller 41 is brought into pressure contact with the driven roller 48 at the operating position to be reversely rotated to convey a sheet toward the processing tray 37 side, and the paddle rotating body 42 is reversely rotated to transfer a sheet toward the second switchback path 31*b*. Further, the lifting roller 41 is brought into pressure contact with the driven roller 48 at the operating positon to be normally rotated to reversely convey a sheet bundle from the processing tray 37 side to the first tray 49 side. This point will be described later (see (3-4)).

The sheet guide member 44 is disposed between the lifting roller 41 and the raking rotating body 46. The sheet guide member 44 is vertically moved between a retreated position (dashed line of FIG. 3) and a guide position (continuous line of FIG. 3). When a sheet is carried out from the sheet discharge port 35, the sheet guide member 44 is located at the retreated position and guides the rear end of a sheet onto the processing tray 37 after the sheet rear end passes through the sheet discharge port 35. To this end, the sheet guide member 44 is connected to a non-illustrated drive mechanism that operates using a second conveying motor as a drive source and vertically moved in accordance with a timing at which the sheet rear end is guided from the sheet discharge port 35 onto the processing tray 37.

Two sheet pressing members 45 are each a plate-like member, and the leading ends thereof are positioned on one side of two raking rotating bodies 46 which are arranged in the front and rear sides of FIG. 3 in the present embodiment. More specifically, the leading end of one sheet pressing member 45 is positioned on the front side of the front side raking rotating body 46, and the leading end of the other sheet pressing member 45 is positioned on the rear side of the rear side raking rotating body 46. Further, each sheet pressing member 45 is mounted to the roller shaft of the sheet discharge roller 36*b* so as to be swingable by its own weight. That is, the leading ends of the sheet pressing members 45 are positioned outside of the two raking rotating bodies 46 so as to be shifted in phase in the depth direction in FIG. 3. Thus, each sheet pressing member 45 is turned in the counterclockwise direction as the number of sheets stacked on the processing tray 37 is increased. The drive force from the above-mentioned non-illustrated second conveying motor is also transmitted to the raking rotating bodies 46.

(3-2) Aligning Mechanism

Figure 6:
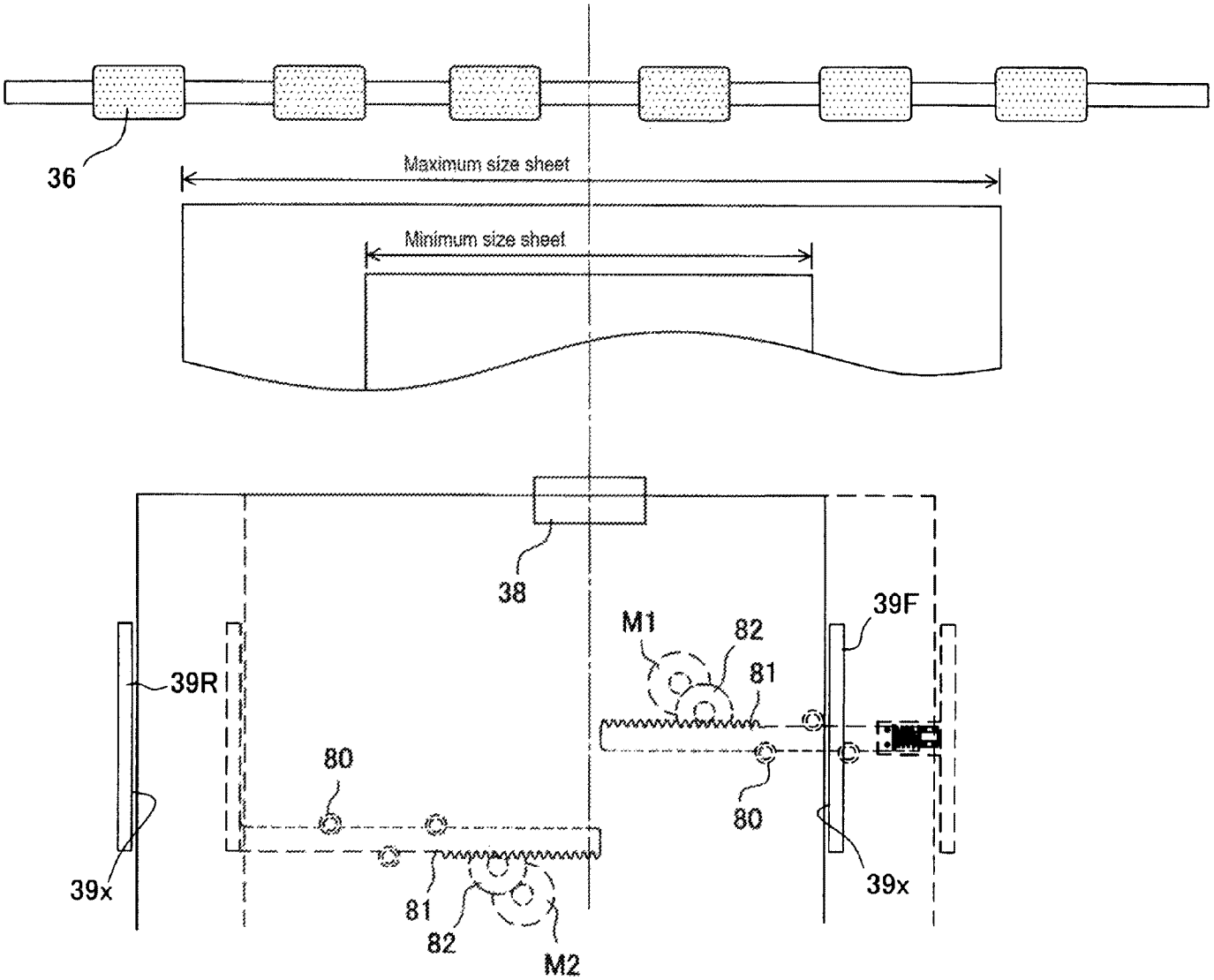
FIG. 6 is an explanatory view illustrating the relationship among a processing tray, a side edge aligning member, and a sheet.

As illustrated in FIG. 6, an aligning mechanism that aligns conveyed sheets is disposed in the processing tray 37. The aligning mechanism includes a regulating member 38 against which the rear end (leading end in the conveying direction of a sheet conveyed on the second switchback path 31*b*) of a sheet abuts for alignment and a side edge aligning member 39 that presses the side edges of sheets to a reference position (e.g., aligned with respect to the center).

As illustrated in FIGS. 3 and 6, the regulating member 38 is a stopper piece having a substantially U-like cross section, against which the rear end of a sheet abuts for alignment. As described later, the regulating member 38 is configured to be reciprocated along the processing tray 37 (the second switchback path 31*b*) as will be described later (see (3-4)) and, when functioning as a part of the aligning member, it is located at a home position (position illustrated in FIGS. 3 and 6). In this regard, a limit sensor (not illustrated) that detects whether or not the regulating member 38 is located at the home position is provided.

As illustrated in FIG. 6, the side edge aligning member 39 is constituted of a pair of front and rear aligning members 39F and 39R (front aligning member 39F is provided on the device front side, and rear aligning member 39R is on the device rear side) disposed on both sides (left and right sides of FIG. 6) of sheets conveyed onto the processing tray 37 in the width direction (direction perpendicular to the sheet conveying direction) thereof so as to be opposed to each other. The front and rear aligning members 39F and 39R are collectively referred to as "aligning member".

The aligning members 39F and 39R are each a plate-like member protruded upward from a sheet placing surface 37*a* (see FIG. 3) and each have a regulating surface 39*x* against which the side edge of a sheet abuts. When aligning conveyed sheets with respect to the center, the aligning members 39F and 39R are reciprocated between a standby position previously set in accordance with a sheet size and an aligning position at which they press the sheets for alignment. With this configuration, a moving distance is reduced as compared to a case where the aligning members 39F and 39R are reciprocated between the home position separated further away from the sheet side edge than the standby position and aligning position, thereby reducing a time required for sheet aligning processing.

Here, a case where sheet bundles are offset to each other is considered. In this case, when an odd-numbered (e.g., first sheet bundle) sheet bundle is formed on the processing tray 37, the aligning members 39F and 39R are each moved from the standby position to the aligning position every time a sheet constituting the sheet bundle is conveyed onto the processing tray 37 as described above to form a center-reference sheet bundle; while when an even-numbered (e.g., second sheet bundle) sheet bundle is formed on the processing tray 37, the above-mentioned aligning position is shifted to the left or right by a predetermined distance. That is, the aligning members 39F and 39R are each moved from the standby position to the thus shifted aligning position every time a sheet constituting the sheet bundle is conveyed onto the processing tray 37 to form a sheet bundle. The above sheet bundle offset method is one example, and various offset methods may be used. Alternatively, sheets may be aligned with reference to the side. In this case, when the sheet bundles are offset, a method may be adopted, in which an odd-numbered sheet bundle is aligned with respect to the center, while an even-numbered sheet bundle is aligned with reference to the side.

The aligning members 39F and 39R are supported on the processing tray 37 such that the regulating surfaces 39*x* thereof are moved in the direction approaching or separating from each other. That is, slit grooves (not illustrated) penetrating the processing tray 37 are formed in the processing tray 37, and the aligning members 39F and 39R can be slid along the slit grooves, respectively.

Further, the aligning members 39F and 39R are each supported by a plurality of guide rollers 80 (or a rail member) on the back side of the processing tray 37 so as to be slidable, and a rack 81 is integrally formed with the guide rollers 80. Aligning motors M1 and M2 are connected to the respective left and right racks 81 through pinions 82, respectively. The aligning motors M1 and M2 are each a reversible stepping motor. The aligning motors M1 and M2 detect the positions of the respective aligning members 39F and 39R using non-illustrated position sensors, respectively, and can move the aligning members 39F and 39R in both the left and right directions by a specified moving amount based on detection values from the respective sensors.

Alternatively, in place of using the rack-and-pinion mechanism, a configuration may be adopted, in which the front and rear aligning members 39F and 39R are fixed to a timing belt connected, by a pulley, to a motor that reciprocates the belt left and right.

(3-3) Stapler Unit

As illustrated in FIG. 3, a stapler unit 47 that staples the rear end side of a sheet bundle aligned by the aligning mechanism is disposed at one side of the processing tray 37. The stapler unit 47 is configured to be movable along the rear end side of the sheet placing surface 37*a* of the processing tray 37.

As illustrated in FIG. 3, a traveling rail 53 and a traveling cam 54 are formed in a device frame 27*a*. On the other hand, in the stapler unit 47, a first roller 83 engaged with the traveling rail 53 and a second roller 84 engaged with the traveling cam 54 are provided. Further, the stapler unit 47 has a ball-like sliding roller 85 engaged with a support surface of the device frame 27*a* (specifically, two sling rollers 85 are provided on the front and rear sides of FIG. 3). Furthermore, the stapler unit 47 has a guide roller 86. The guide roller 86 is engaged with the bottom surface of the device frame 27*a* to prevent floating of the stapler unit 47 from the device frame 27*a*.

Thus, the stapler unit 47 is supported on the device frame 27*a* so as to be movable by the sliding roller 85 and guide roller 86, and the first and second traveling rollers 83 and 84 can be moved along the traveling rail 53 and the traveling cam 54, respectively, while being rotated along the traveling rail 53 and traveling cam 54.

Figure 7:
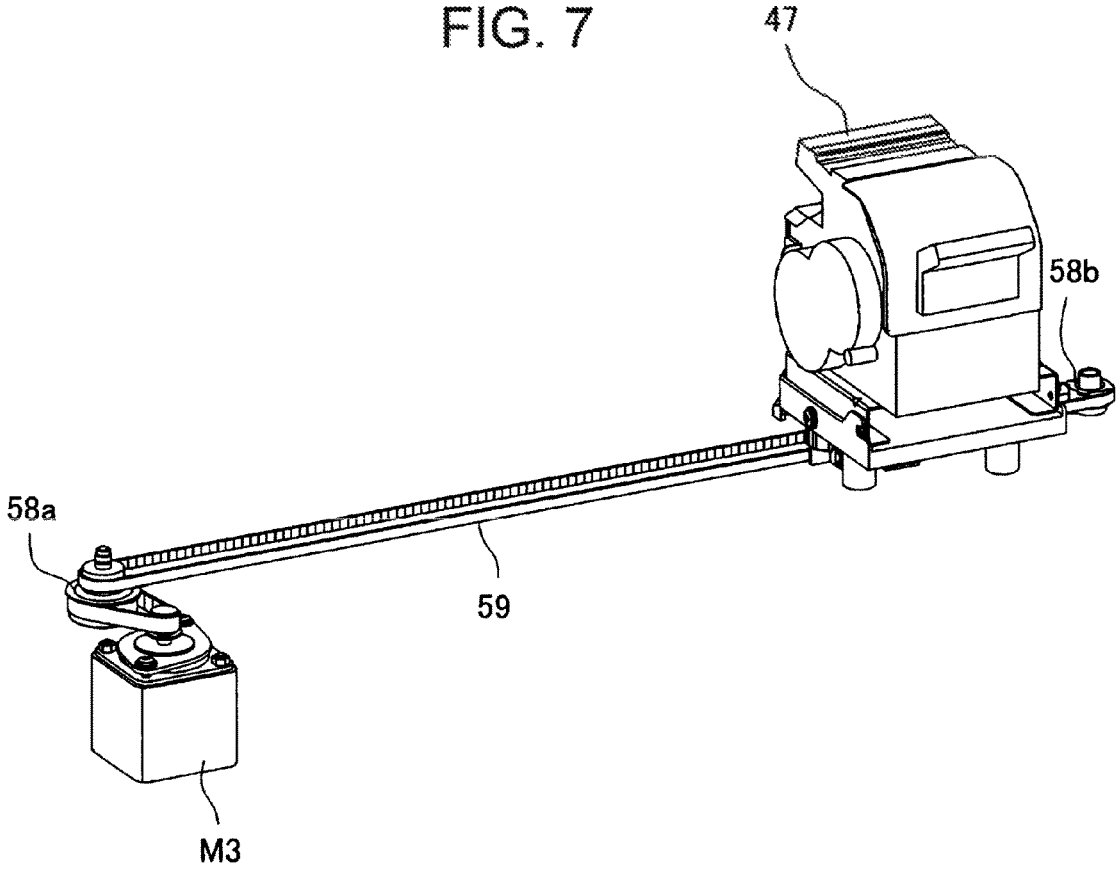
FIG. 7 is a perspective view of a moving mechanism for a stapler unit.

FIG. 7 illustrates a moving mechanism for the stapler unit 47. The stapler unit 47 is fixed to a timing belt 59 stretched between gear pulleys 58*a* and 58*b*. When a drive force from a reversible drive motor M3 is transmitted to the gear pulley 58*a*, the stapler unit 47 is reciprocated along the rear end of the sheet placing surface 37*a* of the processing tray 37.

Figure 8:
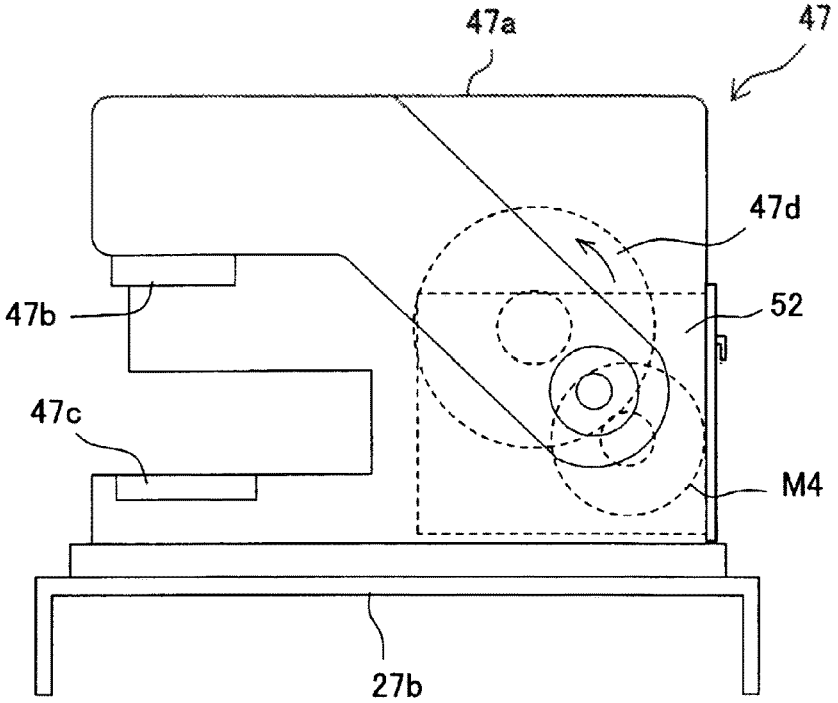
FIG. 8 is an explanatory view of the stapler unit.

As illustrated in FIG. 8, the stapler unit 47 is formed as a unit separated from the sheet post-processing device B. That is, the stapler unit 47 has a box-like unit frame 47*a*, and a drive cam 47*d* axially supported by the unit frame 47*a* so as to be swingable and a drive motor M4 that turns the drive cam 47*d* are mounted to the unit frame 47*a*.

A stapler head 47*b* and an anvil member 47*c* are disposed opposite to each other, and the stapler head 47*b* is configured to be vertically moved by a biasing spring (not illustrated) from an upper standby position to a lower staple position (anvil member). Further, a needle cartridge 52 is detachably attached to the unit frame 47*a*.

When binding processing is applied to a sheet bundle, the drive motor M4 is used to turn the drive cam 47*d* to store energy in the biasing spring. When the turning angle reaches a predetermined angle, the stapler head 47*b* moves down vigorously toward the anvil member 47*c*. In this operation, a staple needle is bent into a U-like shape and then inserted into the sheet bundle. Then, the tip ends of the staple needle are bent by the anvil member 47*c*, whereby the sheet bundle is bound.

In place of the above-mentioned stapler unit 47, an eco-binding unit that binds a sheet bundle without use of the stapler needle may be used. Further, both the stapler unit 47 and the eco-binding unit may be used in combination. Such a configuration is disclosed in Jpn. Pat. Appln. Laid-Open Publication No. 2015-124084. This publication also discloses details of the traveling rail 53 and traveling cam 54 when left-corner binding, right-corner binding, or multi-binding is performed.

(3-4) Discharge Mechanism

Further, the processing tray 37 is provided with a discharge mechanism that discharges a stacked sheet bundle (sheet bundle aligned by the aligning mechanism or a sheet bundle bound by the stapler unit 47 after the alignment) to the first tray 49. The discharge mechanism is constituted of a conveyer part that pushes out a sheet bundle stacked on the processing tray 37 and a roller part that carries out the sheet bundle while nipping it.

The above-mentioned sheet carry-in mechanism conveys sheets one by one to the processing tray 37 along the second switchback path 31*b*, while the discharge mechanism conveys a sheet bundle stacked on the processing tray 37 along the second switchback path 31*b* in a direction opposite to the direction denoted by the arrow 31*b* of FIG. 4.

Figure 9A:
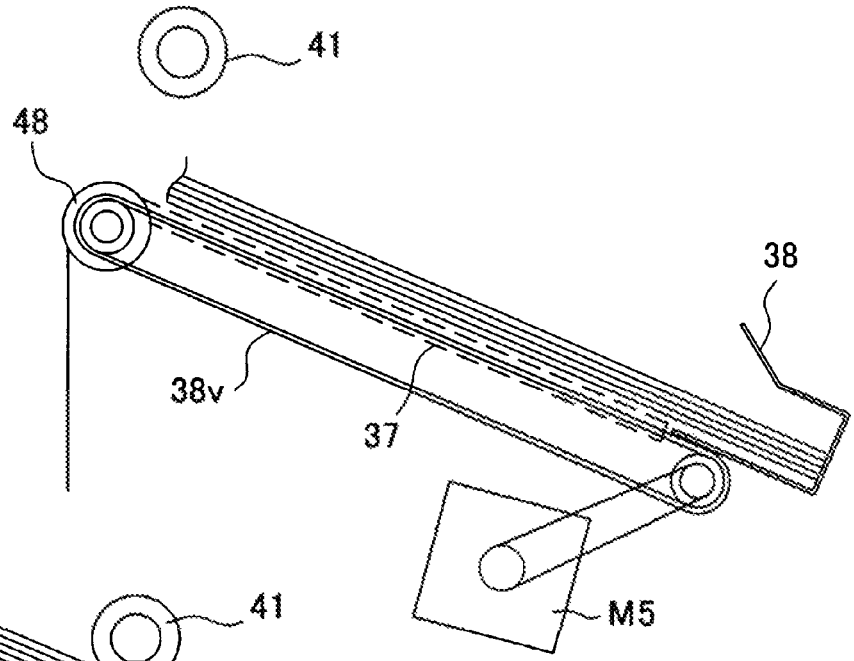
Figure 9B:
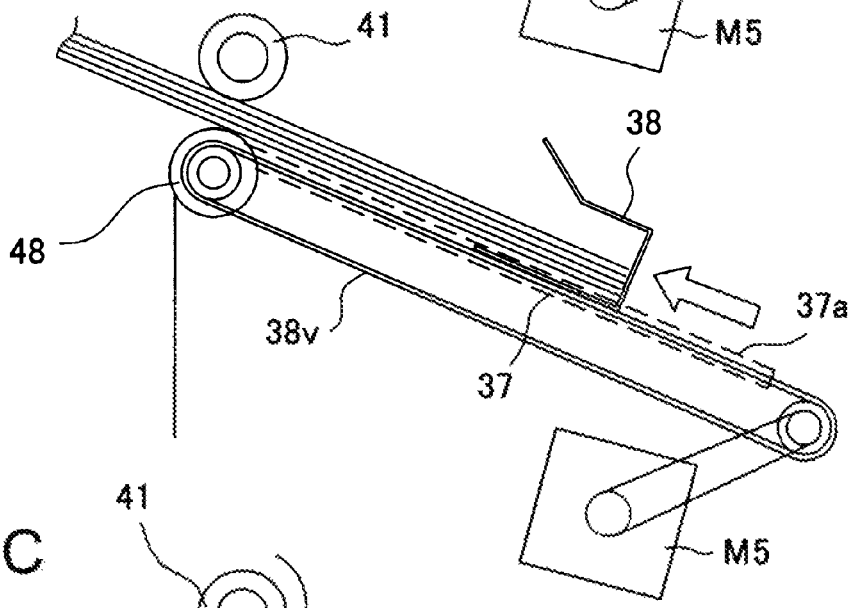
Figure 9C:
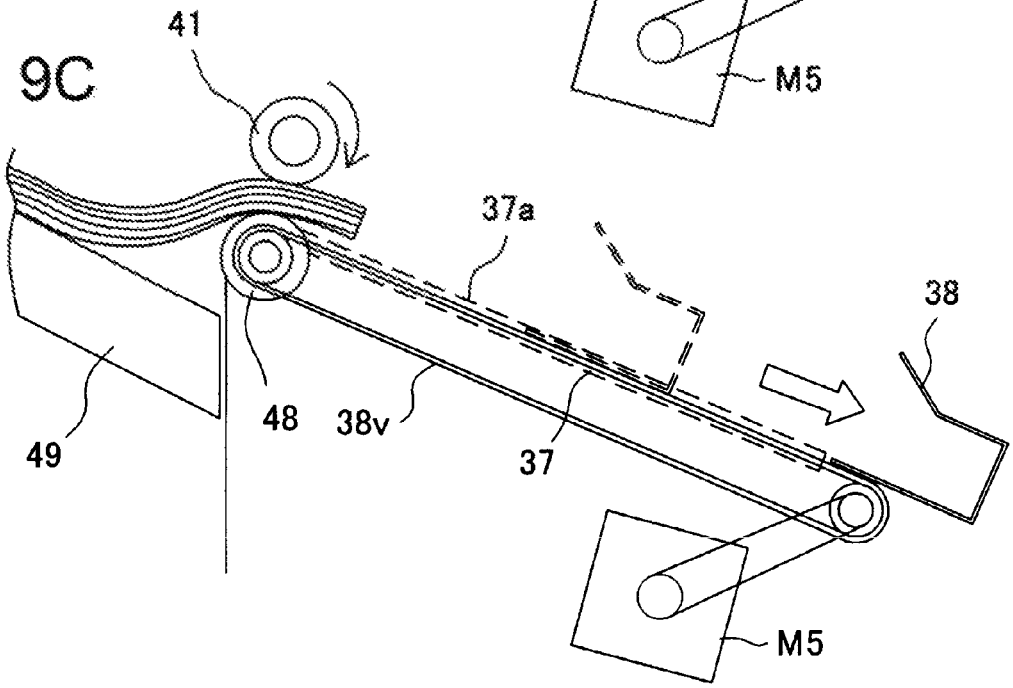

As illustrated in FIGS. 9A to 9C, the conveyer part is constituted of a regulating member 38 that transfers a sheet bundle along the processing tray 37 from the aligning position (binding position) found on the upstream side toward the first tray 49 on the downstream side, a conveyer belt 38*v* that moves the regulating member 38, and a reversible drive motor M5 (stepping motor) that drives the conveyer belt 38*v*. The regulating member 38 is fixed to the conveyer belt 38*v*. The roller part is constituted of a driven roller 48 and a lifting roller 41 brought into pressure contact with the driven roller 48 fixedly located at an operating position.

FIG. 9A illustrates a state of a sheet bundle (sheet bundle aligned by the aligning mechanism or a sheet bundle bound by the stapler unit 47 after the alignment) stacked on the processing tray 37. In this state, the drive motor M5 for driving the conveyer part is stopped, and the lifting roller 41 of the roller part is located at the standby position. When a sheet bundle stacked on the processing tray 37 is discharged onto the first tray 49 by the discharge mechanism, the lifting roller 41 is moved to the operating position at which it is brought into pressure contact with the driven roller 48 by a drive force from a non-illustrated lifting motor and then normally rotated by the non-illustrated second conveying motor, and the drive motor M5 is normally driven.

FIG. 9B illustrates a state where a sheet bundle is being conveyed toward the first tray 49. More specifically, in the state of FIG. 9B, the sheet bundle is being conveyed downstream by movement of the regulating member 38 and rotation of the roller part (lifting roller 41 and driven roller 48). The regulating member 38 is moved along between the above-mentioned two raking rotating bodies 46. FIG. 9C illustrates a state immediately before discharge of a sheet bundle onto the first tray 49. The sheet bundle is gradually fed (at low speed) to the first tray 49 on the downstream side by rotation of the roller part. In this state, the regulating member 38 is moved to the home position by reverse drive of the drive motor M5. Then, when conveyance (discharge) of the sheet bundle onto the first tray 49 is ended, the lifting roller 41 is moved to the standby position by a drive force from the non-illustrated lifting motor.

(4) Second Conveying Path 32

As illustrated in FIGS. 2 and 3, the second conveying path 32 is provided with a conveying roller 55 in the vicinity of the above-mentioned second diverging point D2, and a transmissive type sensor S3 having a light-emitting element and a light-receiving element is disposed downstream of the conveying roller 55. The conveying roller 55 is constituted of a roller pair, and a rotational drive force from the above-mentioned non-illustrated second conveying motor is transmitted to the drive roller pair through a gear. As illustrated in FIG. 2, a carry-out roller 62 driven by the rotational drive force from the non-illustrated second conveying motor is disposed downstream of the sensor S3 and at the end (path end) of the second conveying path 32.

Below the carry-out roller 62, a bookbinding part 60 is disposed. The bookbinding part 60 aligns and accumulates sheets fed through the second conveying path 32 and applies saddle stitching and internal folding to the sheets. Hereinafter, the processing by the bookbinding part 60 is referred to as "magazine finishing".

The bookbinding part 60 includes a guide member 66 that accumulates sheets in a bundle, a regulating stopper 67 that positions sheets at a predetermined position on the guide member 66, a saddle-stitching unit 63 that center-binds the sheets positioned by the regulating stopper 67, and a folding mechanism (folding roller 64 and folding blade 65) that center-folds the sheet bundle bound by the saddle-stitching unit 63. The members constituting the bookbinding part 60 are disposed in a substantially vertical direction.

The saddle-stitching unit 63 has a configuration as disclosed in Jpn. Pat. Appln. Laid-Open Publications No. 2008-184324 and No. 2009-051644. That is, the saddle-stitching unit 63 performs binding processing while being moved along the sheet center line with a sheet bundle held between a head unit and an anvil unit.

As illustrated in FIG. 2, the folding mechanism makes the folding blade 65 abut against a folding line of a sheet bundle caught in the folding roller (pair) 64 brought into pressure contact with each other and folds the sheet bundle by rolling of the folding roller 64. Such a folding mechanism is also disclosed in Jpn. Pat. Appln. Laid-Open Publications No. 2008-184324 and No. 2009-051644.

More specifically, as illustrated in FIG. 2, the folding mechanism according to the present embodiment has, at a folding position Y, the folding roller 64 that folds a sheet bundle and the folding blade 65 that inserts the sheet bundle into a nip position of the folding roller 64. The folding roller 64 is constituted of a pair of drive rollers each formed of a material having a comparatively large friction coefficient, such as a rubber roller, so as to transfer the sheet bundle in the rotation direction thereof while folding it. The folding roller 64 is positioned at a curved or bent protruding side of the guide member 66, and the folding blade 65 having a knife edge opposite to the folding roller 64 across a sheet bundle is provided in a forward/backward movable manner.

The head unit of the saddle-stitching unit 63 is driven by a non-illustrated saddle-stitching motor, and the folding roller 64 is driven by a non-illustrated folding motor. The regulating stopper 67 is located at a predetermined position according to a sheet size by a drive force from a non-illustrated moving motor, and the folding blade 65 is advanced and retreated by a driving force from the non-illustrated folding motor.

A discharge roller 69 is disposed opposite to the folding blade 65 with respect to the folding roller 64. The discharge roller 69 discharges a sheet bundle that has been subjected to the magazine finishing by the bookbinding part 60. A rotational drive force of the discharge roller 69 is also supplied from the non-illustrated folding motor. The device housing 27 is provided with a non-illustrated discharge port formed downstream of the discharge roller 69, and the sheet bundle that has been subjected to the magazine finishing is discharged onto the second tray 61 through the discharge port. In FIG. 2, since the frequency of bookbinding is comparatively low, the second tray 61 is folded (brought into a state where the leading end side of the second tray 61 is turned upward), and the regulating stopper 67 is located at its home position.

(5) Third Conveying Path 30

As illustrated in FIG. 2, the third conveying path 30 is provided with a conveying roller 77 in the middle thereof and a sheet discharge roller 78 upstream of the discharge port 72. The conveying roller 77 and sheet discharge roller 78 are each constituted of a drive roller and a driven roller, and rotational drive force thereof is supplied from the above-mentioned non-illustrated first conveying motor. Thus, the third conveying path 30 is a sheet conveying path dedicated for straight discharge.

2. Controller

The sheet post-processing device B has a controller (hereinafter, referred to as "post-processing controller" in order to distinguish it from the main body controller 90) that controls the entire operation thereof. As illustrated in FIG. 10, the post-processing controller 97 has an MCU 98 incorporating a CPU, a ROM, a RAM, and the like. The MCU 98 is connected to an actuator controller 99 which is connected to the above-mentioned motors or various actuators such as an electromagnetic solenoid. The MCU 98 is also connected to sensors such as sensors S1 to S4.

The MCU 98 of the post-processing controller 97 communicates with the MCU 91 of the main body controller 90 and receives information required for control processing in the sheet post-processing device B, such as post-processing mode, sheet size information, and job end information.

<Processing Mode and Characteristics>

The following describes (post-) processing modes and concept of one job, and characteristics of the sheet post-processing device B.

1. Processing Modes and Concept of One Job

The sheet post-processing device B has the following five processing modes: a) punching processing mode; b) jog sorting mode; c) binding processing mode; d) bookbinding processing mode; and e) straight discharge mode (sometimes referred to as "printout mode").

a) The punching processing mode is a mode to punch a punch hole at the rear end of a sheet using the punch unit 50 and discharge the resultant sheet onto the first tray 49; b) The jog sorting mode is a mode to stack sheet bundles onto the first tray 49 such that they are offset to one another, without performing stapling using the stapler unit 47; c) The binding processing mode is a mode to staple the rear end of a sheet bundle using the stapler unit 47 and discharge the bound sheet bundle onto the first tray 49; d) The bookbinding processing mode is a mode to perform the magazine finishing using the bookbinding part 60 and discharge the resultant bound sheet bundle onto the second tray 61; and e) The straight discharge mode is a mode to directly discharge a sheet carried into the sheet post-processing device B onto the third tray 71. The jog sorting mode and the binding processing mode can be performed in combination of the punching processing mode.

Figure 11:
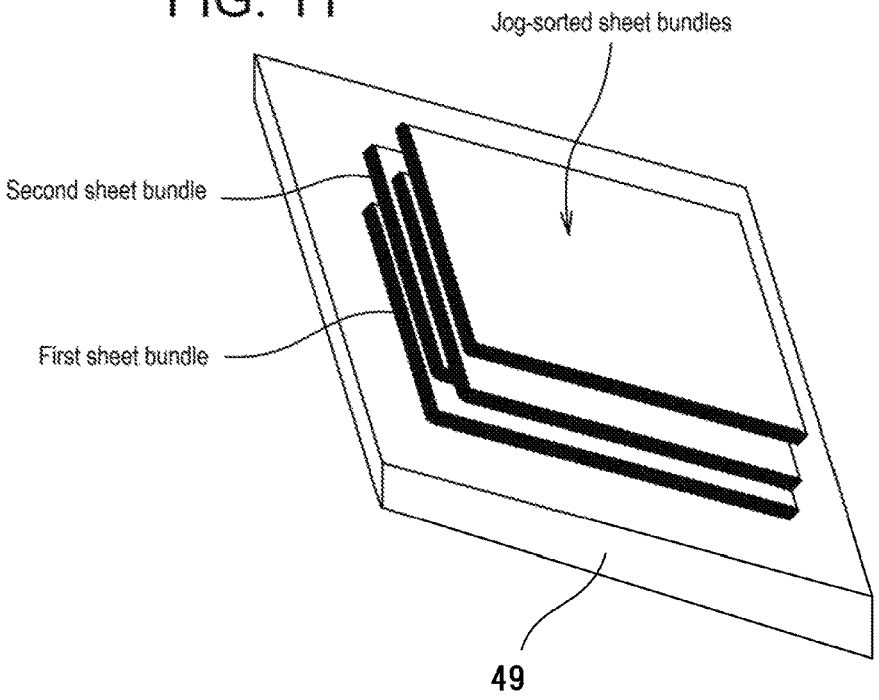
FIG. 11 is an explanatory view schematically illustrating a state where jog-sorted sheet bundles are stacked on the first tray.

FIG. 11 illustrates a state where jog-sorted sheet bundles are stacked on the first tray 49. In FIG. 11, four sheet bundles are stacked on the first tray 49 such that odd-numbered sheet bundles and even-numbered sheet bundles are offset to each other.

The above-mentioned processing modes are specified through touch panel of the image forming device A or through a computer connected to a LAN. At this time, in any of the above modes, the number of sheet bundles may be specified. When the number of sheet bundles is specified (the number of sheet bundles is 2 or more (particularly, in the processing modes b), c), and d))), information indicating the number of sheets (corresponding to the number of documents in the case of copy) constituting one sheet bundle is required.

The number of sheets constituting one sheet bundle is not usually input by an operator; however, the main body controller 90 of the image forming device A can grasp it by the MCU 91 referring to the number of image data stored in the memory 96 or to header information received from the computer through the LAN. Thus, the main body controller 90 gives, as post-processing mode information, information (e.g., the jog sorting mode) indicating the specified processing mode and its attribute information (the number of sheet bundles and the number of sheets constituting one sheet bundle) to the post-processing controller 97. When the number of sheet bundles is 1, the number of sheet bundles is not usually specified. Further, when the number of sheet bundles is 1, the post-processing controller 97 does not require information indicating the number of sheets constituting one sheet bundle. That is, when the number of sheet bundles is 1, the attribute information is unnecessary. In other words, when the processing mode is specified while there is no attribute information (the number of sheet bundles is not specified), it can be determined that the number of sheet bundles is 1.

In the processing modes a) and e), the post-processing controller 97 may process sheets carried in from the image forming device A one by one, so that the above-mentioned attribute information (the number of sheet bundles, the number of sheets constituting one sheet bundle) is not required. In this case, the post-processing controller 97 can grasp job end (completion of a job in the image forming system) on the sheet post-processing device B side by receiving job end information (see FIG. 10) indicating job end on the image forming device A side from the main body controller 90.

From the above, concept of one job in the sheet post-processing device B is made clear. That is, in the processing modes b), c), and d), a specified number of sheet bundles are processed according to the specified processing mode; while in the processing modes a) and e), processing is continued until the final sheet carried in after reception of the job end information is processed according to the specified processing mode.

2. Characteristics of Sheet Post-Processing Device B

The sheet post-processing device B is characterized as follows. That is, when a first sheet bundle is formed on the first tray 49, sheets constituting the first sheet bundle are divided into a plurality of sets and discharged a plurality of times for each set. At this time, the number of sheets included in a sheet set to be discharged at the first time is smaller than the maximum number of sheets included in sheet sets to be discharged at the second and subsequent times. The reason for this is to prevent the lowermost sheet of the sheets constituting the first sheet bundle that directly contacts the surface of the first tray 49 from being displaced in position from other sheets due to the difference in friction coefficient between the surface of the first tray 49 and the sheet.

Specifically, in a case where the first sheet bundle is formed on the first tray 49 when the post-processing mode information indicates "jog sorting mode (the number of sheet bundles: 4, the number of sheets constituting one sheet bundle: 12)", sheets are divided into sets of 1 (sheet)-5 (sheets)-5 (sheets)-1 (sheet), 2 (sheets)-5 (sheets)-5 (sheets), 3 (sheets)-4 (sheets)-5 (sheets), 4 (sheets)-3 (sheets)-5 (sheets), or 2 (sheets)-2 (sheets)-4 (sheets)-4 (sheets) for discharge to the first tray 49. From the reason for the dividing discharge, the second to fourth sheet bundles need not be subjected to "dividing discharge" (meaning that sheets constituting one sheet bundle are divided into a plurality of sets and discharged a plurality of times for each set) and may be stacked on the first tray 49 such that they are offset to one another.

According to the above characteristics, when the first sheet bundle is formed on the first tray 49, the sheets constituting the first sheet bundle may be divided into two sets of 1 (sheets)-11 (sheets), and when the second to fourth sheet bundles are formed, 12 sheets constituting each sheet bundle may be discharged at a time. However, in this case, a high torque motor is required as a drive source in order to ensure reliability of the device. Conversely, when the maximum number of sheets for dividing discharge is small, reliability can be ensured even when a reasonable cost (low torque) motor is used. From this perspective, in the present embodiment, the maximum number of sheets for dividing discharge is set to 5 (sheets) (hereinafter, referred to as "set number"). This maximum number (5 sheets) is an example, and the present invention is not limited thereto.

<Operation>

The following describes operation of the image forming system according to the first embodiment with the MCU 91 of the main body controller 90 and MCU 98 of the post-processing controller 97 as operation subjects. Since the individual operations of the respective components have been already described, operation in the entire system and its control will be described hereinafter.

[Image Forming Device]

When an operator depresses a start button on the touch panel, the MCU 91 fetches, through the touch panel controller 94, information input to the touch panel and makes the scanner unit A2 read a document and output read image data to the memory 96. Then, the MCU 91 transmits the above-mentioned post-processing mode information and sheet size information to the MCU 98 of the post-processing controller 97.

Then, the MCU 91 rotates, through the sheet supply controller 93, a pickup roller of an operator's desired sheet cassette to deliver a sheet and drives the conveying roller 7 on the sheet feed path 6. As a result, the delivered sheet is conveyed on the sheet feed path 6 toward the resist roller pair 8. A sensor (not illustrated) is disposed upstream of the resist roller pair 8, and the resist roller pair 8 is maintained in a rotation stop state for a predetermined period of time after the leading end of a conveyed sheet is detected by the sensor, whereby the leading end of the conveyed sheet is aligned with a predetermined position.

The MCU 91 drives the resist roller pair 8 and other conveying rollers into rotation after elapse of the above predetermined time and operates respective sections constituting the image forming section 3 through the image formation controller 92 to form an image onto the sheet and discharge the image-formed sheet from the sheet discharge port 16 through the sheet discharge path 14. When the processing on the image forming device A side is ended, the MCU 91 transmits the above-mentioned job end information to the MCU 98. Prior to the operation of the image forming section 3, the MCU 91 controls the image formation controller 92 to operate the feeder unit A3 or the scanner unit A2 according to the user's specification to acquire image data of the document (store the image data in the memory 96) and makes the image forming section 3 form an image onto the sheet according to the acquired image data.

[Sheet Post-Processing Device]

1. Grasping of processing Mode

The MCU 98 waits until it receives the post-processing mode information and sheet size information from the MCU 91 and, upon receiving these items of information, grasps which one (or a plurality of) of the (post-) processing modes a) to e) has been specified and executes post-processing specified by the operator.

That is, the MCU 98 refers to the post-processing mode information to determine whether or not the specified processing mode is the jog sorting mode. When making an affirmative determination, the MCU 98 executes the jog sorting mode to be described later; while when making a negative determination, the MCU 98 determines whether or not the specified processing mode is the binding processing mode. When making an affirmative determination, the MCU 98 executes the binding mode to be described later; while when making a negative determination, the MCU 98 determines whether or not the specified processing mode is the punching mode. When making an affirmative determination, the MCU 98 executes the punching mode to be described later; while when making a negative determination, the MCU 98 determines whether or not the specified processing mode is the bookbinding mode. When making an affirmative determination, the MCU 98 executes the bookbinding mode to be described later. When the straight discharge mode is performed, the operator does not usually make a specification therefor, so that when making a negative determination in the determination on whether or not the specified processing mode is the bookbinding mode, the MCU 98 determines that the straight discharge mode is specified and executes straight discharge processing to be described later.

Figure 12:
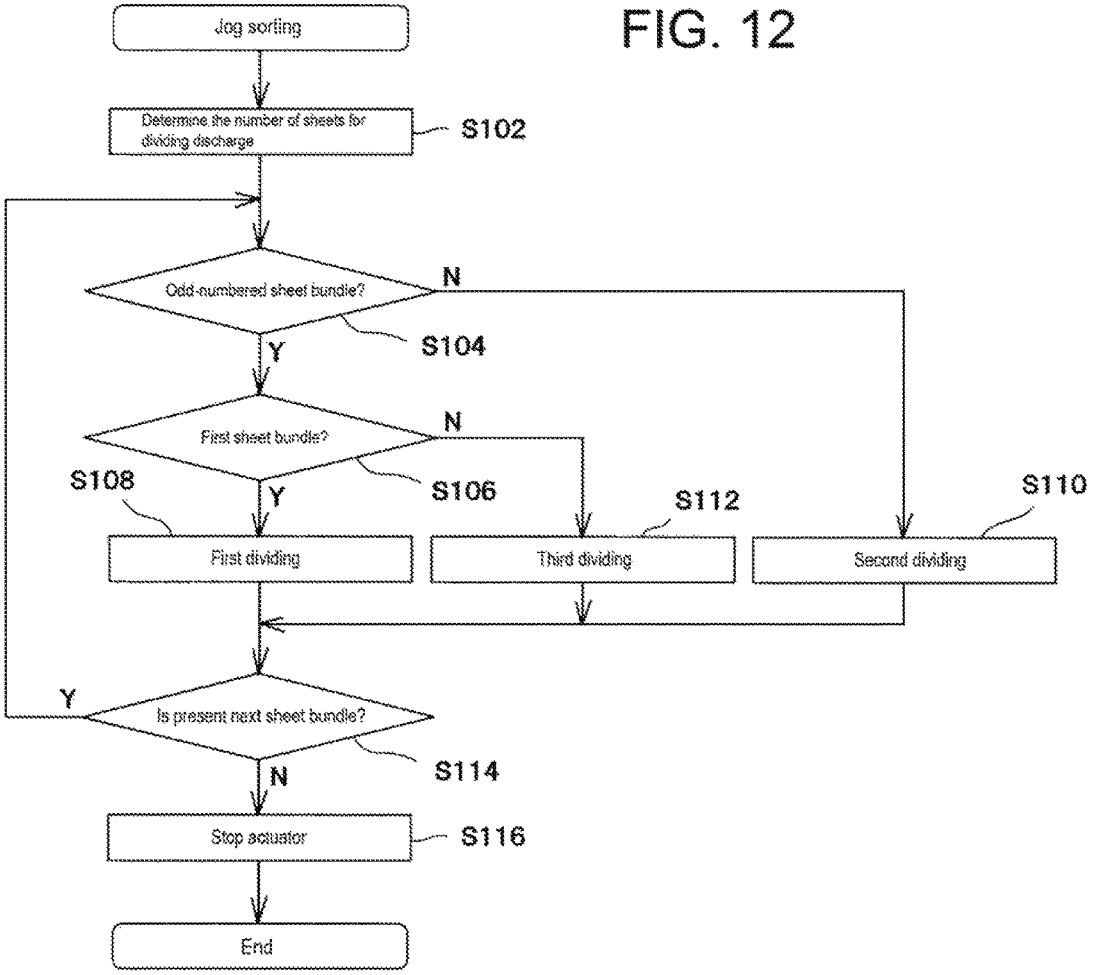
FIG. 12 is a flowchart of a jog sorting routine executed by an MCU of a post-processing controller in the first embodiment.

2. Jog Sorting Processing (1) Determination of Number of Sheets for Dividing Discharge In the jog sorting processing (see FIG. 12), the MCU 98 refers to the attribute information (the number of sheet bundles, the number of sheets constituting one sheet bundle) of the post-processing mode information to execute processing (hereinafter, referred to as "division number determination processing") of determining the number of sheets included in each set constituting one sheet bundle so as to perform the dividing discharge onto the first tray 49 (S102). Here, it is assumed that information of the above set number (5 sheets) is previously stored in the ROM of the MCU 98 and loaded into the RAM.

First, the MCU 98 determines the number of sheets included in the first sheet set constituting the first sheet bundle. That is, the MCU 98 refers to the attribute information to determine whether or not X: the number of sheets constituting one sheet bundle is equal to or more than the set number (5 sheets). When making an affirmative determination, the MCU 98 sets the number of sheets included in the first sheet set constituting the first sheet bundle to 2 sheets. The number "2 (sheets)" is an example, and the number may optionally be set as long as it is less than (5 sheets).

Then, the MCU 98 determines the number of sheets included in the second set constituting the first sheet bundle. The MCU 98 calculates the residual number of sheets (X-2 sheets) and determines whether or not the residual number (X-2 sheets) exceeds the set number (5 sheets). When making an affirmative determination, the MCU 98 sets the number of sheets included in the second set to the set number (5 sheets); while when making a negative determination, the MCU 98 sets the number of sheets included in the second set to the residual number (X-2 sheets). Further, when making an affirmative determination, the MCU 98 determines the number of sheets included in the third set in the same manner.

On the other hand, when making a negative determination in the determination of the number of sheets included in the first sheet set constituting the first sheet bundle (X: the number of sheets constituting one sheet bundle is less than the set number (five sheets)), the MCU 98 sets the number of sheets included in the first sheet set constituting the first sheet bundle to one. In this case, the number of sheets included in the second set constituting the first sheet bundle is set to (X-1 sheets), with the result that two sheet sets are discharged onto the first tray 49 to form the first sheet bundle.

According to the above example, when the attribute information indicates (12: the number of sheets constituting one sheet bundle), the number of sheets included in the first sheet set constituting the first sheet bundle is 2 (sheets), and the number of sheets included in the second set is 5 (sheets), the number of sheets included in the third set is 5 (sheets). Thus, three sheet sets (2 sheets-5 sheets-5 sheets) are discharged onto the first tray 49 to form the first sheet bundle.

Then, the MCU 98 determines the number of sheets included in the first sheet set constituting the second sheet bundle. when making an affirmative determination in the determination of the number of sheets included in the first sheet set constituting the first sheet bundle (X: the number of sheets constituting one sheet bundle is equal to or more than the set number (five sheets)), the MCU 98 sets the numbers of sheets included in the first sheet sets constituting the second and subsequent sheet bundles to the set number (five sheets). Then, the MCU 98 determines the numbers of sheets included in the second sheet sets constituting the second and subsequent sheet bundles. The MCU 98 calculates the residual number of sheets (X-2 sheets) and determines whether or not the residual number (X-2 sheets) exceeds the set number (five sheets). When making an affirmative determination, the MCU 98 sets the number of sheets included in the second set to the set number (five sheets); while when making a negative determination, the MCU 98 sets the number of sheets included in the second set to the residual number (X-2 sheets). Further, when making the affirmative determination, the MCU 98 determines the numbers of sheets included in the third and subsequent sheet sets in the same manner.

On the other hand, when making a negative determination in the determination of the number of sheets included in the first sheet set constituting the first sheet bundle (X: the number of sheets constituting one sheet bundle is less than the set number (five sheets)), the MCU 98 sets the numbers of sheets included in the first sheet sets constituting the second and subsequent sheet bundles to X: the number of sheets constituting one sheet bundle. Thus, in this case, for the second and subsequent sheet bundles, the sheets constituting each sheet bundle are discharged at a time.

According to the above example, when the attribute information indicates (12: the number of sheets constituting one sheet bundle), the numbers of sheets included in the first sheet sets constituting the second and subsequent sheet bundles are 5 (sheets), and the number of sheets included in the second sheet set is 5 (sheets), the number of sheets included in the third set is 2 (sheets). Thus, three sheet sets (5 sheets-5 sheets-2 sheets) are discharged onto the first tray 49 to form the second and subsequent sheet bundles.

(2) Determination of Number of Sheet Bundles To Be Processed

Then, the MCU 98 determines whether or not the sheet bundle being currently processed is an odd-numbered sheet bundle (S104). When making an affirmative determination, the MCU 98 determines whether the odd-numbered sheet bundle is the first sheet bundle (S106). Such determination can be made by referring to the attribute information (the number of sheet bundles) of the post-processing mode information and counting the number of sheet bundles to be processed using a counter. In place of or together with this approach, another approach may be taken, in which the MCU 98 monitors the output of the fourth sensor S4 incorporated in the first tray 49 (after receiving the post-processing mode information from the MCU 91) and determines that the sheet bundle currently being processed is the first sheet bundle when no sheet is present on the first tray 49. That is, the MCU 98 determines that the sheet bundle to be formed after (immediately after) it determines that no sheet is present on the first tray 49 based on the output of the fourth sensor S4 is the first sheet bundle and then sets the number of sheets included in the first sheet set constituting the first sheet bundle to 2 (sheets) (a value smaller than the maximum number of sheets included in the subsequent sheet sets). When the above two approaches are used in combination, the MCU 98 monitors the output of the fourth sensor S4 incorporated in the first tray 49 (after receiving the post-processing mode information from the MCU 91) and, when any sheet is present on the first tray 49, notifies the MCU 91 of the presence of the sheet. Upon reception of the notification, the MCU 91 may display the corresponding information on the touch panel through the touch panel controller 94.

(3) First Dividing Processing

In the determination of the above (2), when determining that the sheet bundle being currently processed is the first sheet bundle (affirmative determination in S106), the MCU 98 executes first dividing processing to form the first sheet bundle on the first tray 49 (S108). Hereinafter, for simplicity, a case where three sheet sets (2 sheets-5 sheets-5 sheets) are discharged onto the first tray 49 to form the first sheet bundle will be described.

(3-1) Conveyance/Stacking Processing

The MCU 98 drives the non-illustrated first conveying motor through the actuator controller 99. As a result, the carry-in roller 29 starts rotating. At this time, the electromagnetic solenoid that turns the first and second flappers 33 and 34 is in an off-state (see FIG. 5A). When the punching processing mode is also specified (this has been grasped in "1. Grasping of processing Mode"), the MCU 98 activates a non-illustrated unit moving motor through the actuator controller 99 according to the sheet size information to locate the punch unit 50 at a predetermined position perpendicular to the sheet carry-in path 28 (to prepare the punching processing) and monitors the output from the first sensor S1.

When the first sensor S1 detects the leading end of a sheet carried into the sheet carry-in path 28, the MCU 98 normally drives the non-illustrated second conveying motor through the actuator controller 99. As a result, the sheet discharge roller 36 starts a normal rotation. Further, the MCU 98 counts the number of sheets every time the first sensor S1 detects the sheet being carried into the sheet carry-in path 28.

When the punching processing mode is also specified, the MCU 98 waits until the second sensor S2 detects the leading end of a sheet. After the second sensor S2 detects the sheet leading end, the MCU 98 further drives the non-illustrated first and second conveying motors by a predetermined number of steps and then stops them. As a result, the sheet being conveyed on the sheet carry-in path 28 is nipped by the sheet discharge roller 36 and the carry-in roller 29 to be stopped. In this state, the sheet leading end goes beyond the sheet discharge port 35 to be positioned on the first conveying path 31.

The MCU 98 drives the non-illustrated punch motor through the actuator controller 99 to make the punch unit 50 perform punching processing. After completion of the punching processing, the MCU 98 drives the non-illustrated first and second conveying motors to convey the sheet further downstream. On the other hand, when the punching processing mode is not specified, the MCU 98 conveys the sheet further downstream without stopping the not illustrating first and second conveying motors even after the second sensor S2 detects the rear end of the sheet.

Then, when the second sensor S2 detects the sheet rear end, the MCU 98 drives the aligning motors M1 and M2 through the actuator controller 99 in accordance with the sheet size information to move the aligning members 39F and 39R from the home position or standby position at which they are located in the previous job to a standby position according to the sheet size set in the current job. Then, after the second sensor S2 detects the sheet rear end, the MCU 98 further drives the non-illustrated first and second conveying motors by a predetermined number of steps according to the sheet size and then stops the non-illustrated second conveying motor (the non-illustrated first conveying motor continues driving until the end of the job unless the punching mode is specified). In this state, the sheet rear end is separated from the nip of the sheet discharge roller 36 and runs out of the sheet discharge port 35, with the result that the sheet leading end is placed on the first tray 49.

Then, the MCU 98 reversely drives the non-illustrated second conveying motor and the non-illustrated lifting motor. As a result, the lifting roller 41 (and the paddle rotating body 42) is moved from the standby position to the operating position and brought into pressure contact with the driven roller 48 to be reversely rotated, and the sheet guide member 44 is moved from the retreated position illustrated in FIG. 3 to the guide position. In this state, the sheet is conveyed toward the regulating member 38 on the second switchback path 31*b* with the leading end side (rear end side of the second switchback path 31*b*) thereof nipped between the lifting roller 41 and the driven roller 48 and the rear end side thereof guided by the sheet guide member 44. Other members (see (3-1) of 1. Mechanism Part in <Configuration>[Sheet Post-Processing Device]) constituting the sheet carry-in mechanism also provide assistance so that the sheet leading end is conveyed on the second switchback path 31*b* toward the regulating member 38.

The MCU 98 further reversely drives the non-illustrated second conveying motor by a predetermined number of steps from the time point at which the lifting roller 41 is brought into pressure contact with the driven roller 48 (lifting roller 41 is located at the operating position) and then stops it. As a result, the sheet rear end abuts against the regulating member 38 located at the home position, and the sheet is carried into the processing tray 37. Then, the MCU 98 normally drives the non-illustrated lifting motor to move the lifting roller 41 from the operating position to the standby position, normally drives the non-illustrated second conveying motor to move the sheet guide member 44 to the retreated position illustrated in FIG. 3, and then stops both the motors.

Then, the MCU 98 drives the aligning motors M1 and M2 to move the aligning members 39F and 39R from the above-mentioned standby position to an aligning position previously set in accordance with the sheet size. As a result, the side edges of the sheet whose rear end abuts against the regulating member 38 for regulation are pressed by the regulating surfaces 39*x* of the aligning members 39F and 39R, with the result that the sheet on the processing tray 37 is aligned with reference to, e.g., the center. After completion of the alignment by the aligning mechanism, the MCU 98 moves the aligning members 39F and 39R to their respective standby positions to be ready for alignment of the next sheet.

Figure 13A:
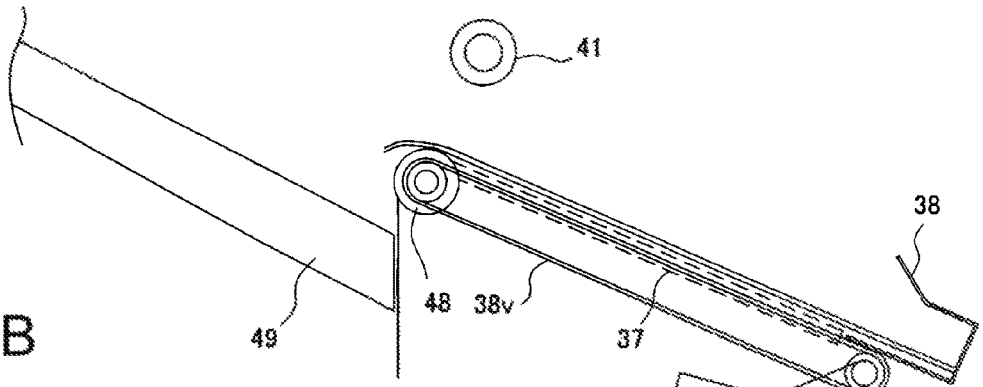

By the above conveyance/stacking processing, the first sheet of the first sheet set (two sheets) constituting the first sheet bundle is aligned/stacked on the processing tray 37. Then, the MCU 98 aligns/stacks the second sheet of the first sheet set constituting the first sheet bundle on the processing tray 37 by the same conveyance/stacking processing. As a result, according to the above example, the first sheet set (two sheets) constituting the first sheet bundle is stacked on the processing tray 37. This state is illustrated in FIG. 13A.

(3-2) Discharge Processing

Figure 13B:
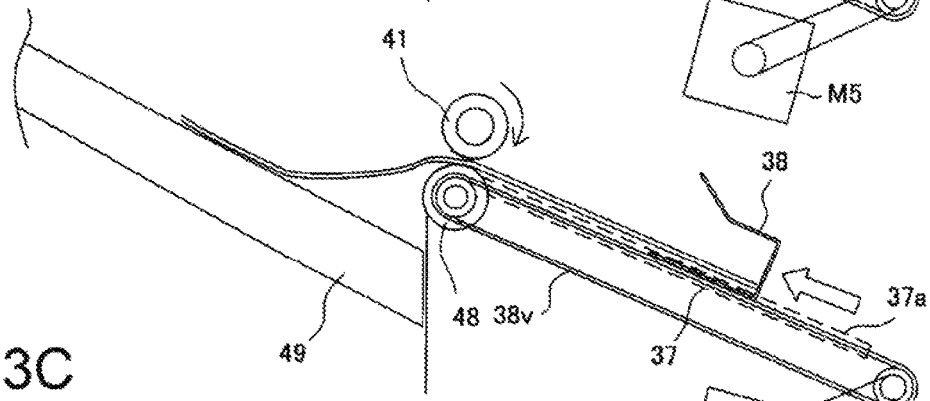
Figure 13C:
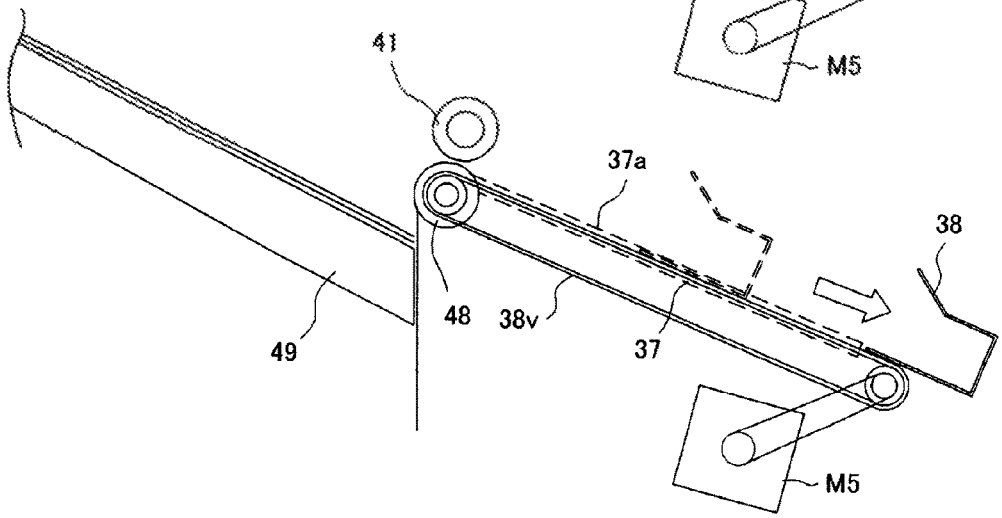

After the first sheet set (two sheets) is stacked on the processing tray 37, the MCU 98 reversely drives the non-illustrated lifting motor to locate the lifting roller 41 at the operating position and normally drives both the non-illustrated second conveying motor and the drive motor M5 through the actuator controller 99 to discharge the first sheet set (two sheets) stacked on the processing tray 37 toward the first tray 49 (in the opposite direction of the second switchback path 31*b*). FIG. 13B illustrates a state where the first sheet set is being discharged toward the first tray 49, and FIG. 13C illustrates a state where discharge of the first sheet set onto the first tray 49 is completed.

As described above, the regulating member 38 that presses the rear end of the first sheet set, the lifting roller 41, and the driven roller 48 discharge the first sheet set toward the first tray 49 in cooperation with one another during discharge of the first sheet set onto the first tray 49; however, the regulating member 38 presses the rear end halfway during the discharge processing and is then set back to the home position. Afterward, the first sheet set is discharged only by the lifting roller 41 and the driven roller 48 to the first tray 49 (see (3-4) of 1. Mechanism Part in <Configuration>[Sheet Post-Processing Device]).

Thus, the MCU 98 normally drives the drive motor M5 by a predetermined number of steps corresponding to a distance between the home position to a point in the middle of the processing tray 37 and then reversely drives the drive motor M5 to set back the same to the home position. Thereafter, the MCU 98 stops the drive motor M5 by referring to the output of the above-mentioned limit sensor. As a result, the regulating member 38 is located at the home position. Further, the MCU 98 normally drives the non-illustrated second conveying motor by a number of steps according to the sheet size and then stops it. Then, after discharge of the first sheet set (two sheets) onto the first tray 49 is completed, the MCU 98 reversely drives the non-illustrated lifting motor to locate the lifting roller 41 at the standby position. As a result, discharge processing of the first sheet set (two sheets) onto the first tray 49 is completed. At this time point (every time discharge of one sheet set is completed), the MCU 98 determines whether or not processing for the number of sets determined in the division number determination processing (S102) is completed. When making a negative determination, the MCU 98 executes processing for the next sheet set; when making an affirmative determination, the MCU 98 ends the first dividing processing (and advances to S114).

Then, the MCU 98 executes the conveyance/stacking processing and discharge processing in the same manner as described above to discharge the second sheet set constituting the first sheet bundle onto the first tray 49. According to the above example, the number of sheets included in the second set is five (sheets). Thus, five sheets are stacked on the processing tray 37 in the conveyance/stacking processing, and the five sheets stacked on the processing tray 37 are discharged onto the first sheet set on the first tray 49 in the discharge processing. Then, the MCU 98 executes the conveyance/stacking processing and discharge processing in the same manner as described above to discharge the third sheet set (five sheets) constituting the first sheet bundle onto the first tray 49.

Figure 14A:
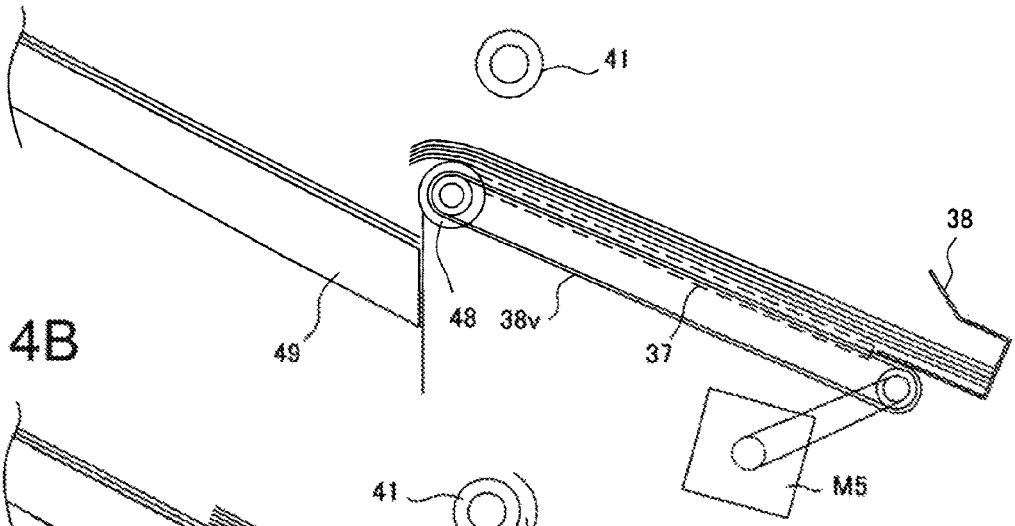
Figure 14B:
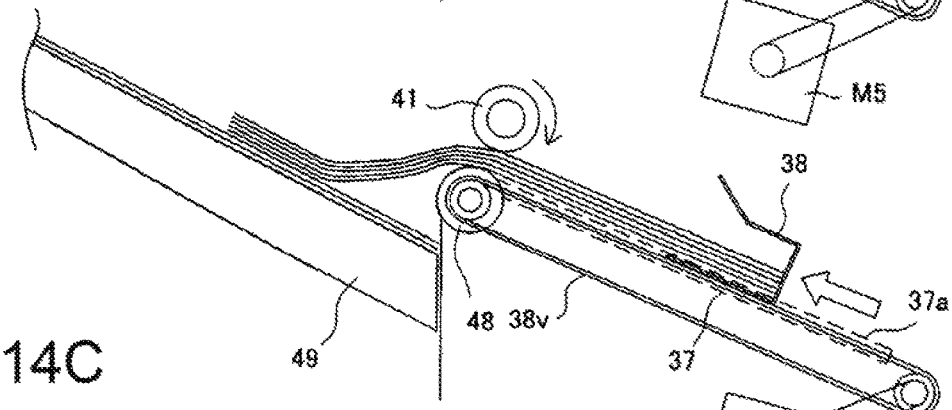
Figure 14C:
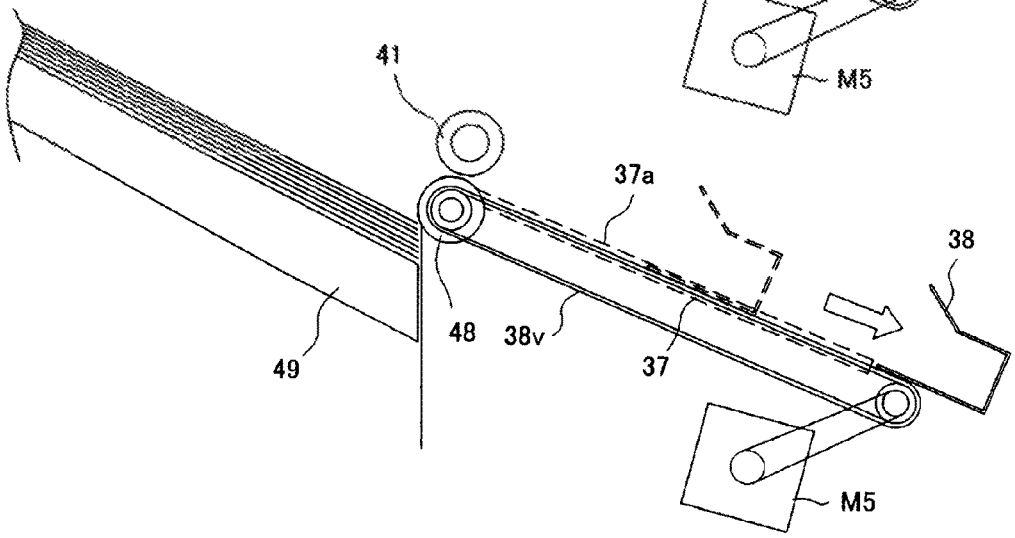

FIG. 14A illustrates a state immediately before the second sheet set (five sheets) is discharged onto the first sheet set (two sheets) on the first tray 49, FIG. 14B illustrates a state where the second sheet set (five sheets) is being discharged, and FIG. 14C illustrates a state where discharge of the second sheet set (five sheets) is completed.

According to the above example, completion of discharge of the third sheet set (five sheets) constituting the first sheet bundle onto the first tray 49 means the end of the first dividing executed by the MCU 98. Subsequently, the MCU 98 determines whether or not there is a sheet bundle (second sheet bundle) to be processed next (S114). According to the above example, the number of sheet bundles is four, so that an affirmative result is made. When making the affirmative determination, the MCU 98 determines whether or not the sheet bundle to be processed next is the odd-numbered sheet bundle according to the determination processing of S104. In this determination, a negative determination is made since the sheet bundle to be processed next is the second (even-numbered) sheet bundle. When making a negative determination, the MCU 98 executes second dividing to form an even-numbered sheet bundle on the first tray 49 (S110).

(4) Second Dividing Processing

According to the above example, the even-numbered sheet bundles (second and subsequent sheet bundles) are each divided into three sets of 5 (sheets)-5 (sheets)-2 (sheets). This has been determined in the division number determination processing of S102. The second dividing differs from the first diving in the following points: (A) three sets of 5 (sheets)-5 (sheets)-2 (sheets) are discharged onto the first tray 49 to form a sheet bundle; and (B) sheets constituting each set are shifted on the processing tray 37 for jog sorting. Description of point (A) may overlap that of the first dividing processing and so will be omitted, and only the point B will be described below.

In the conveyance/stacking processing of the first dividing processing, the MCU 98 drives the aligning motors M1 and M2 to move the aligning members 39F and 39R from the standby position to the aligning position to thereby align the sheet with respect to the center; while in the conveyance/stacking processing of the second dividing processing, the MCU 98 shifts the aligning position set in the conveyance/stacking processing of the first dividing leftward or rightward by a predetermined distance (in the example of FIG. 11, aligning position is shifted toward the left in FIG. 6). That is, the MCU 98 moves the aligning members 39F and 39R from the standby position to the shifted aligning position for each sheet conveyed to the processing tray 37 to thereby align the sheets on the processing tray 37.

After completion of the second dividing processing, the MCU 98 determines whether or not there is a sheet bundle (third sheet bundle) to be processed next (S114). When making an affirmative determination, the MCU 98 determines whether or not the sheet bundle to be processed next is the odd-numbered sheet bundle (S104). When making an affirmative determination, the MCU 98 determines whether or not the current processing is processing for the first sheet bundle (S106). According to the above example, this is processing for the third sheet bundle, so that a negative determination is made here. When making the negative determination, the MCU 98 executes third dividing processing to form the third sheet bundle on the first tray 49 (S112).

(5) Third Dividing Processing

According to the above example, the third sheet bundle (second and subsequent sheet bundles) is divided into three sets of 5 (sheets)-5 (sheets)-2 (sheets). This has been determined in the division number determination processing of S102. The third dividing processing differs from the first diving processing only in that three sets of 5 (sheets)-5 (sheets)-2 (sheets) are discharged onto the first tray 49 to form a sheet bundle, so that description of which may overlap that of the first dividing and so will be omitted.

After completion of the third dividing processing, the MCU 98 determines whether or not there is a sheet bundle (fourth sheet bundle) to be processed next (S114). When making an affirmative determination, the MCU 98 determines whether or not the sheet bundle to be processed next is the odd-numbered sheet bundle (S104). According to the above example, this is processing for the fourth sheet bundle (even-numbered sheet bundle), so that a negative determination is made here. The MCU 98 executes the second dividing processing so as to form the fourth sheet bundle on the first tray 49 (S110).

(6) End Processing

Then, the MCU 98 determines whether or not there is a sheet bundle to be processed next (S114). The first to fourth sheet bundles have thus been processed, so that according to the above example, a negative determination is made in S114. When making the negative determination, the MCU 91 confirms reception of the job end information from the MCU 91 and stops the actuator such as a motor (S116) to end the jog sorting processing (ends the jog sorting routine).

3. Binding Processing

The binding processing differs from the jog sorting processing in the following four points.

(A) The post-processing mode information concerning the jog sorting processing is, according to the above example, "jog sorting mode (the number of sheet bundles: 4, the number of sheets constituting one sheet bundle: 12)"; while the post-processing mode information concerning the binding processing is, for example, "binding mode (the number of sheet bundles: 4, the number of sheets constituting one sheet bundle: 12, binding method: two-position binding)". That is, "binding method" is added to the attribute information. The "binding method" is specified by an operator inputting it on the touch panel of the image forming device A or through a LAN-connected computer. As disclosed in the above Jpn. Pat. Appln. Laid-Open Publication No. 2015-124084, various binding methods, such as left-corner binding, right-corner binding, and multi-binding (including the above two-position binding) are known. The sheet post-processing device B can perform such binding methods; however, for simplification, it is assumed that the "two-position binding" is specified as the "binding method". Further, in a case where an operator does not specify the "binding method", the "two-position binding" can be regarded as being specified.

(B) In the jog sorting processing, the above dividing processing is performed for processing of one sheet bundle; while in the binding processing, such dividing processing is not performed. That is, in the conveyance/stacking processing ((3-1) in 2. Jog Sorting Processing), all the sheets (12 sheets, according to the above example) constituting one sheet bundle are aligned/stacked on the processing tray 37, and in the discharge processing ((3-2) in 2. Jog-Sorting), all the sheets constituting one sheet bundle are discharged at a time onto the first tray 49.

(C) In the jog sorting processing, sheets constituting an even-numbered sheet bundle are shifted on the processing tray 37 at the time of alignment; while in the binding processing, such a shift operation is unnecessary (all the sheets constituting one sheet bundle may be aligned with reference to, e.g., the center, irrespective of whether the sheet bundle to be processed is an odd-numbered sheet bundle or an even-numbered sheet bundle).

(D) In the jog sorting processing, stapling is not performed; while in the binding processing, the stapling is performed between the conveyance/stacking processing and the discharging processing.

Hereinafter, the above different points (A) to (D) will be mainly described. Further, it is assumed here that the MCU 98 receives the above post-processing mode information ("binding mode (the number of sheet bundles: 4, the number of sheets constituting one sheet bundle: 12, binding method: two-position binding)") from the MCU 91. Note that a table describing binding positions each associated with the sheet size and binding mode is assumed to be stored in the ROM of the MCU 98 and loaded in the RAM.

Based on the attribute information "the number of sheets constituting one sheet bundle: 12", the MCU 98 repeats the above conveyance/stacking processing until 12 sheets constituting the first sheet bundle are stacked on the processing tray 37. After all the sheets constituting the first sheet bundle are aligned/stacked on the processing tray 37 with reference to, e.g., the center, the MCU 98 executes stapling using the stapler unit 47.

That is, the MCU 98 drives the drive motor M3 (see FIG. 7) through the actuator controller 99 by referring to the above table to move the stapler unit 47 to the first binding position and then drives the drive motor M4 (see FIG. 8) to move down the stapler head 47*b* toward the anvil member 47*c*. As a result, the sheet bundle is stapled at the first one of the two binding positions. Then, the MCU 98 drives the drive motor M3 by referring to the above table to move the stapler unit 47 to the second binding position and then drives the drive motor M4 to move down the stapler head 47*b* toward the anvil member 47*c*. As a result, the sheet bundle aligned/stacked on the processing tray 37 is stapled at two portions at the rear end thereof.

Then, the MCU 98 discharges the stapled sheet bundle stacked on the processing tray 37 onto the first tray 49 in the same manner as the above discharge processing. This discharge processing has been already described with reference to FIG. 9. Then, the MCU 98 determines whether or not a sheet bundle to be processed next is present. When making an affirmative determination, the MCU 98 repeats the above processing; when making a negative determination, the MCU 98 confirms reception of the job end information from the MCU 91 and stops the actuator such as a motor to end the binding processing.

4. Punching Processing

The punching processing has partially been described in the jog sorting processing (3-1). Thus, a control after the sheet is punched will be described. It is assumed here that the post-processing mode is "punching mode" and does not include attribute information.

After the sheet is punched, the MCU 98 drives the non-illustrated first and second conveying motors which are in a stop state to convey the punched sheet further downstream. After elapse of a predetermined time from when the second sensor S2 detects the sheet rear end, the MCU 98 reversely drives the non-illustrated lifting motor to move the lifting roller 41 which is being normally rotated by the normal drive of the non-illustrated second conveying motor from the standby position to the operating position. As a result, the sheet is conveyed toward the first tray 49 by the lifting roller 41 and the sheet discharge roller 36 (see FIG. 19B).

After the second sensor S2 detects the sheet rear end, the MCU 98 further normally drives the non-illustrated second conveying motor by a predetermined number of steps previously set in accordance with the sheet size and stops it. As a result, the punched sheet is discharged onto the first tray 49 (see FIG. 19C). Thereafter, the MCU 98 normally drives the non-illustrated lifting motor to locate the lifting roller 41 at the standby position.

Thus, the discharge processing of the sheet onto the first tray 49 is completed. Then, the MCU 98 determines whether to have received the job end information from the MCU 91. When making a negative determination, the MCU 98 repeats the above processing; when making an affirmative determination, the MCU 98 processes the final sheet after reception of the job end information in the same manner and stops the actuator such as a motor to end the punching processing.

5. Bookbinding Processing

Like the above, it is assumed that the post-processing mode information is "bookbinding mode (the number of sheet bundles: 4, the number of sheets constituting one sheet bundle: 12)".

(1) Conveyance/Accumulation Processing

The MCU 98 drives the non-illustrated first conveying motor through the actuator controller 99. As a result, the carry-in roller 29 starts rotating. In this state, the electromagnetic solenoid that turns the first and second flappers 33 and 34 is in an off-state (see FIG. 5A).

When the first sensor S1 detects the leading end of a sheet carried into the sheet carry-in path 28, the MCU 98 normally drives the non-illustrated second conveying motor through the actuator controller 99. As a result, the sheet discharge roller 36 starts normally rotating. Further, the MCU 98 counts the number of sheets every time the first sensor S1 detects that a sheet is carried into the sheet carry-in path 28.

Then, when the second sensor S2 detects the rear end of the sheet, the MCU 98 stops the non-illustrated second conveying motor. At this state, the sheet leading end is positioned above the first tray 49, and the sheet rear end is nipped by the sheet discharge roller 36.

Then, the MCU 98 energizes, through the actuator controller 99, the electromagnetic solenoid that drives the second flapper 34 to turn on the electromagnetic solenoid. As a result, the second flapper 34 is turned clockwise to the position illustrated in FIG. 5C. Further, the MCU 98 drives the non-illustrated moving motor to move the regulating stopper 67 (see FIG. 2) located at the home position or standby position at which it is located in the previous job to a standby position according to the sheet size set in the current job.

Subsequently, the MCU 98 reversely drives the non-illustrated second conveying motor. As a result, the sheet discharge roller 36, the conveying roller 55, and the carry-out roller 62 are reversely driven, with the result that the sheet is carried from the first switchback path 31*a* into the second conveying path 32 through the second diverging point D2 such that the rear end thereof goes ahead as the leading end.

Then, when the third sensor S3 detects the leading end of the sheet (rear end in the conveying direction of the second conveying path 32), the MCU 98 turns off the electromagnetic solenoid that drives the second flapper 34. As a result, the second flapper 34 is turned counterclockwise to the position illustrated in FIG. 5A. Subsequently, the MCU 98 further reversely drives the non-illustrated second conveying motor by a predetermined number of steps after the third sensor S3 detects the sheet leading end and then stops it. As a result, the sheet is separated from the nip of the carry-out roller 62 (discharged from the second conveying path 32), and the sheet rear end (the leading end in the conveying direction of the second conveying path 32) is regulated (supported) by the regulating stopper 67 located at the standby position.

By the above conveyance/accumulation processing, the first sheet constituting the first sheet bundle is accumulated in the guide member 66. The MCU 98 executes the above conveyance/accumulation processing in the same manner by referring to "the number of sheets constituting one sheet bundle" in the attribute information until all the sheets (12 sheets) specified in the attribute information are accumulated in the guide member 66.

(2) Saddle-Stitching Processing

After completion of the conveyance/accumulation processing (after 12 sheets are accumulated in the guide member 66), the MCU 98 executes saddle-stitching processing. That is, the MCU 98 drives the non-illustrated moving motor to move the regulating stopper 67 from the standby position to a position such that the center of the accumulated sheets is located at the binding position of the saddle-stitching unit 63. Then, the MCU 98 drives the non-illustrated saddle-stitching motor through the actuator controller 99 to make the head unit staple the sheets at one or a plurality of positions in the center thereof.

(3) Folding Processing

After completion of the saddle-stitching processing, the MCU 98 drives the non-illustrated moving motor to move the regulating stopper 67 such that the center of the saddle-stitched sheet bundle is positioned at the folding position Y and drives the non-illustrated folding motor through the actuator controller 99. As a result, the folding blade 65 is inserted into the internally folded side of the sheet bundle, with the result that the sheet bundle is internally folded while being caught in the folding roller 64 at low speed, and then the leading end side of the sheet bundle is supported by the discharge roller 69. At the time point at which the saddle-stitched sheet bundle is caught in the folding roller 64 and released from the support of the regulating stopper 67, the MCU 98 drives the non-illustrated moving motor for the next processing to locate the regulating stopper 67 at the standby position and then stops it.

(4) Discharge Processing

The MCU 98 further drives the non-illustrated folding motor and stops it after the rear end of the magazine-finished sheet bundle is separated from the nip of the discharge roller 69. As a result, the magazine-finished sheet bundle is discharged so as to be dropped onto the second tray 61 through a non-illustrated sheet discharge port while being guided by a curved guide plate.

(5) End Processing

Then, the MCU 98 determines whether or not there is a sheet bundle to be processed next. When making an affirmative determination, the MCU 98 repeats the processing of (1) to (4); when making a negative determination, the MCU 98 confirms reception of the job end information from the MCU 91 and stops the actuator such as the motor to end the bookbinding processing.

6. Straight Discharge Processing

It is assumed here that the post-processing mode information is "straight discharge processing" and does not include attribute information. Further, as described above, in a case where an operator does not input the post-processing mode information itself, the "straight discharge processing" can be regarded as being specified.

The MCU 98 drives the non-illustrated first conveying motor through the actuator controller 99. As a result, the carry-in roller 29, a conveying roller 77, and the sheet discharge roller 78 start rotating. Further, the MCU 98 energizes, through the actuator controller 99, the electromagnetic solenoid that drives the first flapper 33 to turn on the electromagnetic solenoid. As a result, the first flapper 33 is turned clockwise to the position illustrated in FIG. 5B. Thus, a sheet carried into the sheet carry-in path 28 through the carry-in port 26 is discharged onto the third tray 71 through the sheet discharge port 72 at the terminating point of the third conveying path 30.

The MCU 98 determines whether to have received the job end information from the MCU 91. When making a negative determination, the MCU 98 maintains the driving state of the non-illustrated first conveying motor and on-state of the electromagnetic solenoid that drives the first flapper 33; when making an affirmative determination, the MCU 98 stops the non-illustrated first conveying motor and energization of the electromagnetic solenoid that drives the first flapper 33 after the final sheet carried in after reception of the job end information is discharged onto the third tray 71 to end the straight discharge processing.

Second Embodiment

Next, a second embodiment of the image forming system to which the present invention can be applied will be described. The present embodiment differs from the first embodiment in that, in the jog sorting processing, the second conveying path 32 is used as the buffer for temporarily retaining each sheet set, in place of the processing tray 37. In the second and subsequent embodiments, the same reference numerals are given to the same components as in the first embodiment, and description thereof will be omitted. Therefore, only the different points will be described below.

<Configuration>

Figure 15:
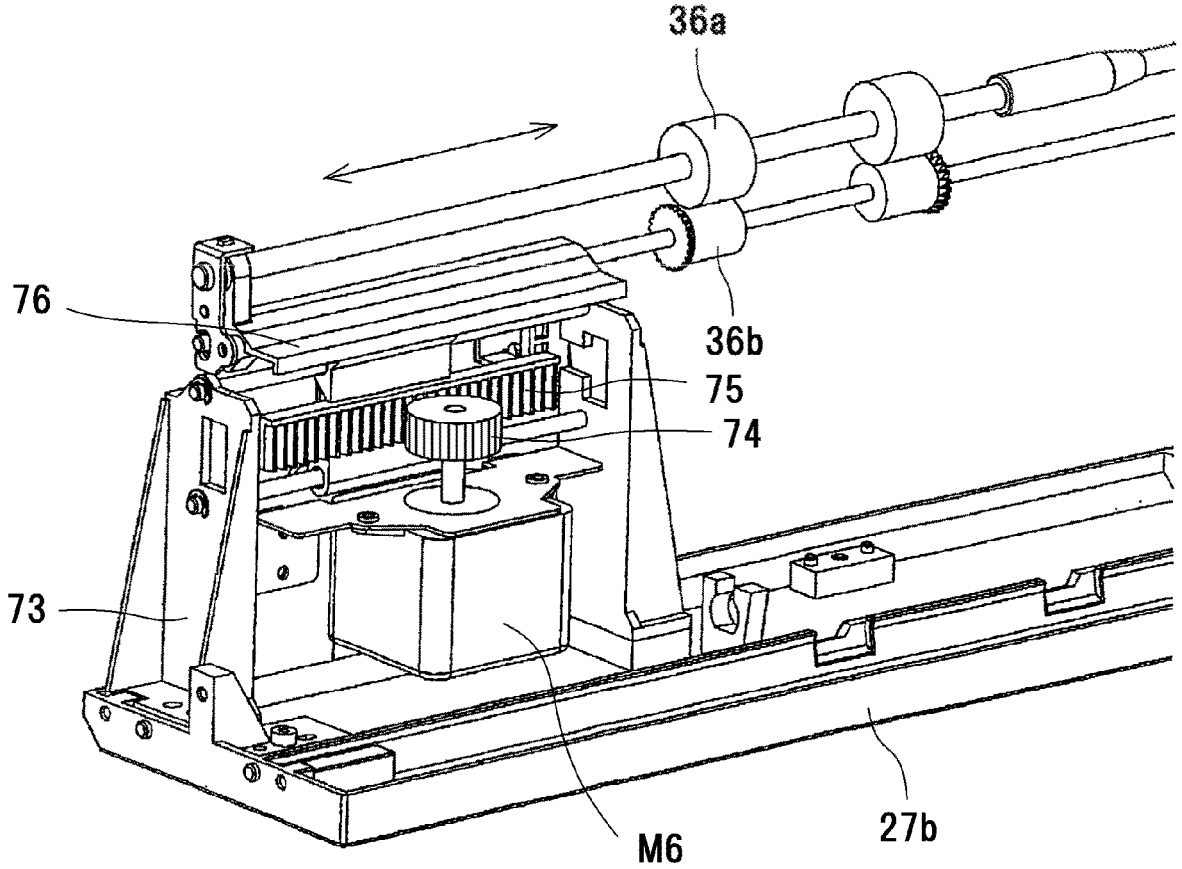
FIG. 15 is a perspective view illustrating a shift mechanism of a sheet post-processing device constituting an image forming system according to a second embodiment.

As illustrated in FIG. 15, the sheet post-processing device B according to the present embodiment has a shift mechanism that shifts a roller shaft of the sheet discharge roller 36. That is, the roller shafts of the pair of the drive rollers 36*a* and 36*b* constituting the discharge roller 36 are axially supported by a bracket 76. The bracket 76 is fixed with a rack 75, and the rack 75 meshes with a pinion 74. The pinion 74 is fitted to a motor shaft of a reversible drive motor M6 (stepping motor). The drive motor M6 is mounted to a motor mounting base 73 fixed to a device frame 27*b*. Thus, by normally and reversely driving the drive motor M6, the sheet discharge roller 36 can be shifted, together with the roller shaft, both in the left and right directions (see the double-headed arrow in FIG. 15) by a specified moving amount.

<Operation>

The same and difference between the jog sorting processing in the present embodiment and that in the first embodiment are as follows: (1) division number determination processing, (2) determination of number of sheet bundles to be processed, and (6) end processing are the same, and only the processing contents of (3) first dividing processing (S108), (4) second dividing processing (S110), and (5) third dividing processing (S112) differ from those in the first embodiment. Thus, in the present embodiment as well, the MCU 98 executes the jog sorting routine illustrated in FIG. 12. It is assumed here that, as in the first embodiment, the post-processing mode information is "jog sorting mode (the number of sheet bundles: 4, the number of sheets constituting one sheet bundle: 12)" and that the first to third sheet bundles are formed by discharging three sets of 2 (sheets)-5 (sheets)-5 (sheets) in the first dividing processing and three sets of (sheets)-5 (sheets)-2 (sheets) in the second and third dividing processing.

(1) First Dividing Processing

When determining that the sheet bundle being currently processed is the first sheet bundle (affirmative determination in S106), the MCU 98 executes the first dividing processing to form the first sheet bundle on the first tray 49 (S108).

The MCU 98 drives the non-illustrated first conveying motor to rotate the carry-in roller 29. At this time, the electromagnetic solenoid that turns the first and second flappers 33 and 34 is in an off-state (see FIG. 5A). When the punching processing mode is also specified, the MCU 98 activates the non-illustrated unit moving motor according to the sheet size information to locate the punch unit 50 at a predetermined position perpendicular to the sheet carry-in path 28 and monitors the output from the first sensor S1.

When the first sensor S1 detects the leading end of a sheet carried into the sheet carry-in path 28, the MCU 98 normally drives the non-illustrated second conveying motor to normally rotate the sheet discharge roller 36. Further, the MCU 98 counts the number of sheets every time the first sensor S1 detects the sheet being carried into the sheet carry-in path 28.

Figure 16A:
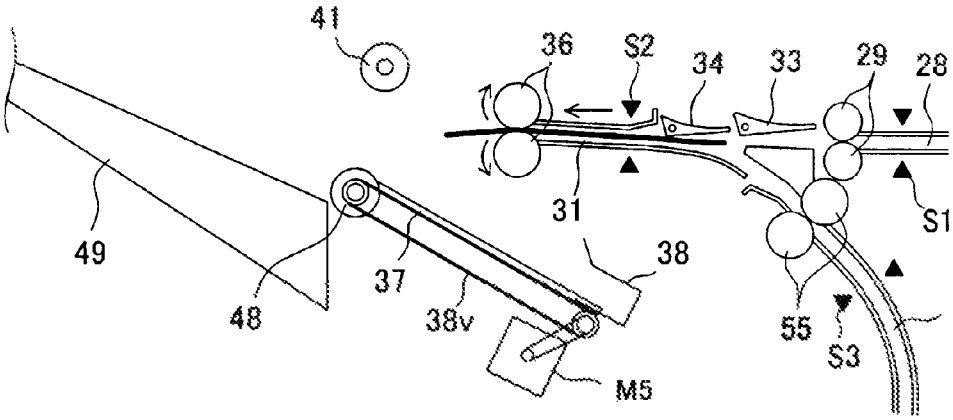

When the punching processing mode is also specified, the MCU 98 waits until the second sensor S2 detects the leading end of a sheet. After the second sensor S2 detects the sheet leading end, the MCU 98 further drives the non-illustrated first and second conveying motors by a predetermined number of steps and then stops them. Then, the MCU 98 drives the punch motor to make the punch unit 50 perform punching processing. After completion of the punching processing, the MCU 98 drives the non-illustrated first and second conveying motors to convey the sheet further downstream. On the other hand, when the punching processing mode is not specified, the MCU 98 conveys the sheet further downstream without stopping the not illustrating first and second conveying motors even after the second sensor S2 detects the rear end of the sheet. This state is illustrated in FIG. 16A.

Then, when the second sensor S2 detects the sheet rear end, the MCU 98 stops the normal drive of the non-illustrated second conveying motor. In this state, the sheet leading end is positioned above the first tray 49, and the sheet rear end is nipped by the sheet discharge roller 36. Then, the MCU 98 turns on the electromagnetic solenoid that drives the second flapper 34 and reversely drives the non-illustrated second conveying motor. As a result, the sheet discharge roller 36, the conveying roller 55, and the carry-out roller 62 are reversely driven, with the result that the sheet is carried from the first switchback path 31*a* into the second conveying path 32 such that the rear end thereof goes ahead as the leading end.

Figure 16B:
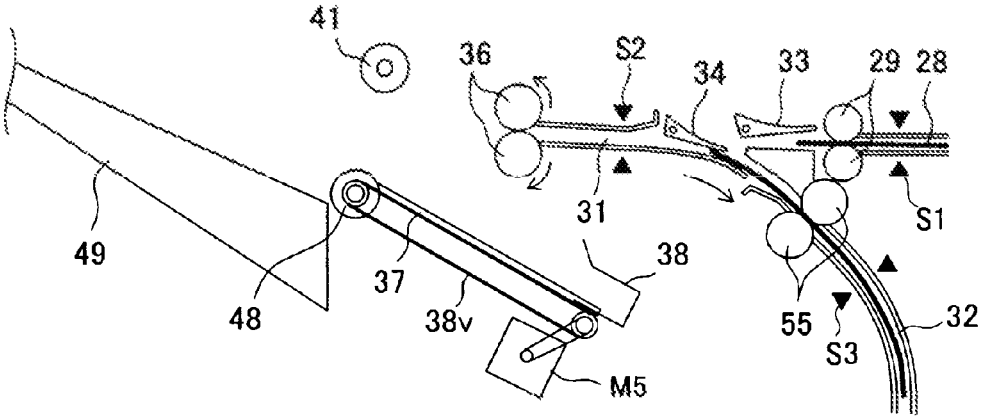

The MCU 98 further reversely drives the non-illustrated second conveying motor by a predetermined number of steps after the third sensor S3 detects the sheet leading end and then stops it. As a result, the sheet is nipped by the conveying roller 55, and the sheet leading end (the rear end in the conveying direction) is located at the second diverging point D2. Then, the MCU 98 waits until the first sensor S1 detects the leading end of the next (second) sheet carried into the sheet carry-in path 28. FIG. 16B illustrates a state immediately after the next sheet is carried into the sheet carry-in path 28.

Figure 16C:
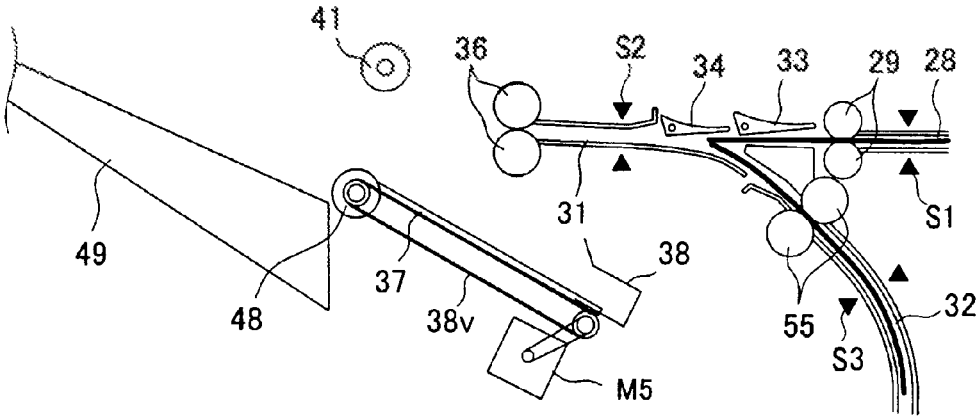

When the first sensor S1 detects the leading end of the next sheet carried into the sheet carry-in path 28, the MCU 98 turns off the electromagnetic solenoid that drives the second flapper 34. As a result, the second flapper 34 is turned counterclockwise to be located at the position illustrated in FIG. 5A. After the first sensor S1 detects the leading end of the next sheet carried into the sheet carry-in path 28, the MCU 98 normally drives the non-illustrated second conveying motor at a timing at which the leading end reaches the second diverging point D2. This timing can be grasped by counting the number of steps of a driver (actuator controller 99) that drives the non-illustrated first conveying motor; however, in the present embodiment, the number of steps is previously stored in the ROM of the MCU 98 and loaded into the RAM, so that the MCU 98 can grasp the timing at which the leading end reaches the second diverging point D2 after the first sensor S1 detects the leading end of the next sheet. FIG. 16C illustrates a state where the leading end of the first sheet and the leading end of the second sheet are aligned with each other immediately after the normal drive of the second conveying motor.

Figure 17A:
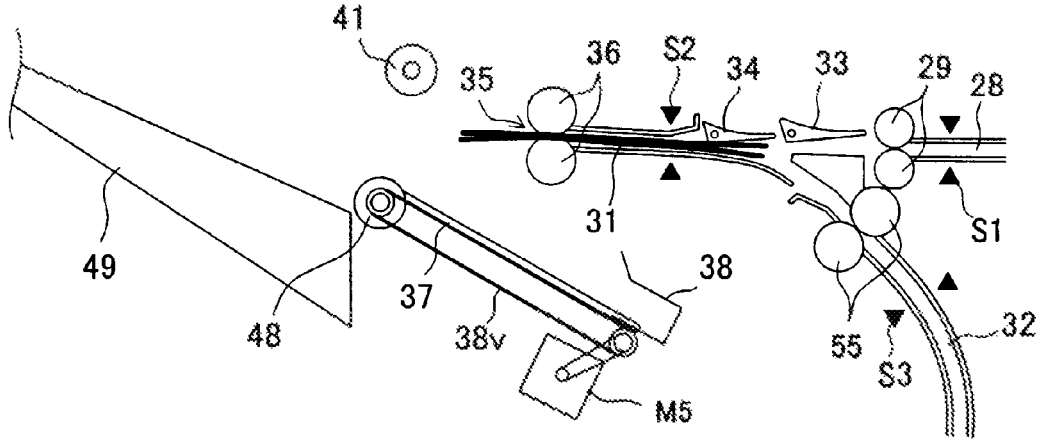

The first and second sheets, in other words, the first sheet set (2 sheets) constituting the first sheet bundle are conveyed on the first conveying path 31 by the rotation of the carry-in roller 29 driven by the non-illustrated first conveying motor and the normal rotation of the sheet discharge roller 36 and the conveying roller 55 normally driven by the non-illustrated second conveying motor with the leading ends thereof aligned. This state is illustrated in FIG. 17A.

Figure 17B:
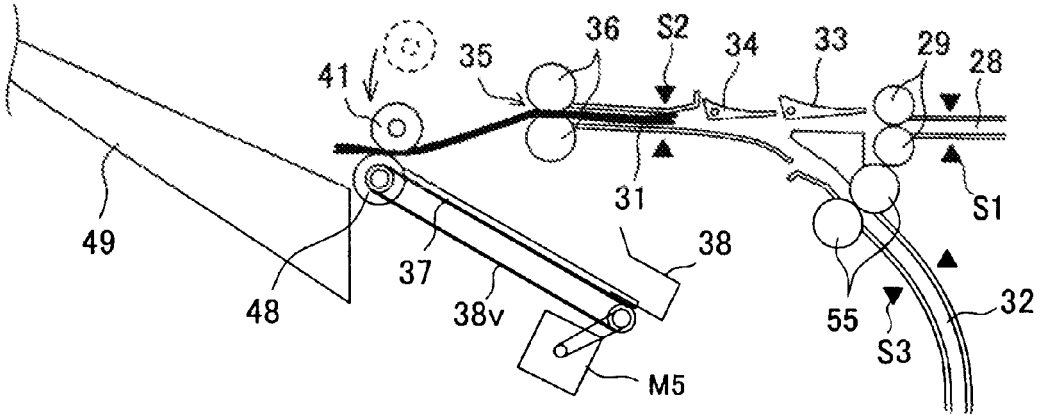

The MCU 98 reversely drives the non-illustrated lifting motor after elapse of a predetermined time from when the second sensor S2 detects the rear end of the first sheet set to locate the lifting roller 41 being normally rotated by the normal drive of the non-illustrated second conveying motor at the operating position. As a result, the first sheet set (two sheets) is conveyed toward the first tray 49 by the lifting roller 41 and the sheet discharge roller 36. This state is illustrated in FIG. 17B.

Figure 17C:
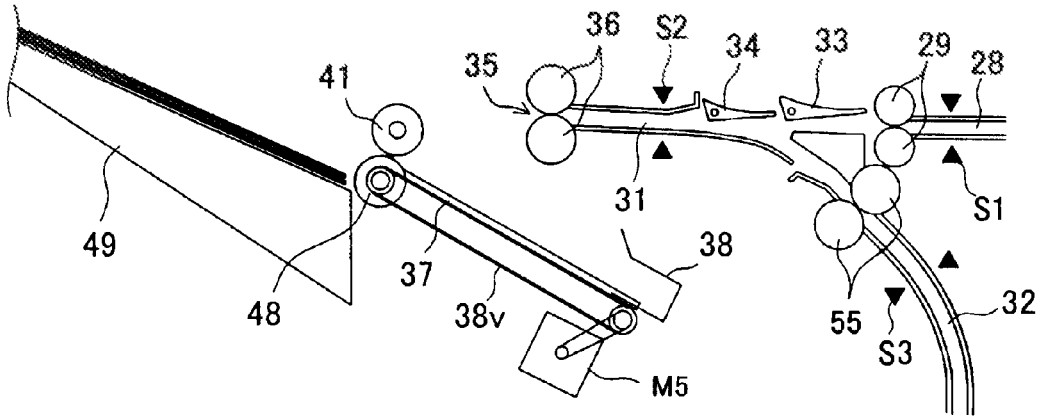

The MCU 98 further normally drives the non-illustrated second conveying motor by a predetermined number of steps according to the sheet size after the second sensor S2 detects the rear end of the first sheet set and then stops it. As a result, the first sheet set (2 sheets) constituting the first sheet bundle is discharged onto the first tray 49. This state is illustrated in FIG. 17C. Thereafter, the MCU 98 normally drives the non-illustrated lifting motor to locate the lifting roller 41 at the standby position.

Thus, discharge processing of the first sheet set (2 sheets) onto the first tray 49 is completed. At this time point (every time discharge of one sheet set is completed), as in the first dividing processing of the first embodiment (see (3-2) in 2. Jog Sorting Processing), the MCU 98 determines whether or not processing for the number of sets determined in the division number determination processing (S102) is completed. When making a negative determination, the MCU 98 executes processing for the next sheet set; when making an affirmative determination, the MCU 98 ends the first dividing processing (and advances to S114).

Then, the MCU 98 executes the conveyance/stacking processing and discharge processing in the same manner as described above to discharge the second sheet set (five sheets) constituting the first sheet bundle onto the first tray 49. Hereinafter, processing for the third and subsequent sheets will be described.

Figure 18A:
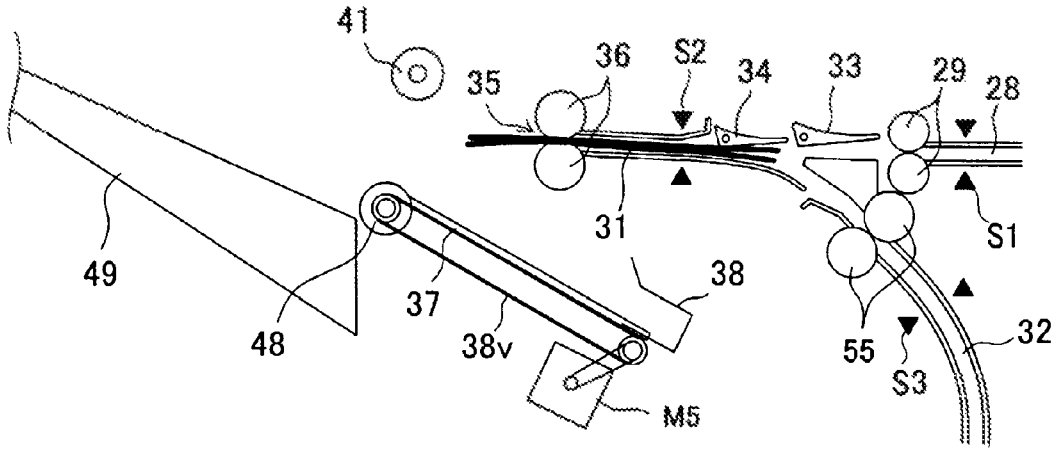

FIG. 18A illustrates the same state as that illustrated in FIG. 17A. When the second sensor S2 detects the rear ends of the sheets (first and second sheets), the MCU 98 stops the normal drive of the non-illustrated second conveying motor, turns on the electromagnetic solenoid that drives the second flapper 34, and then reversely drives the non-illustrated second conveying motor. As a result, the sheet discharge roller 36, the conveying roller 55, and the carry-out roller 62 are reversely rotated, and thus the sheets (first and second sheets) are carried from the first switchback path 31*a* into the second conveying path 32 such that the rear end thereof goes ahead as the leading end.

Figure 18B:
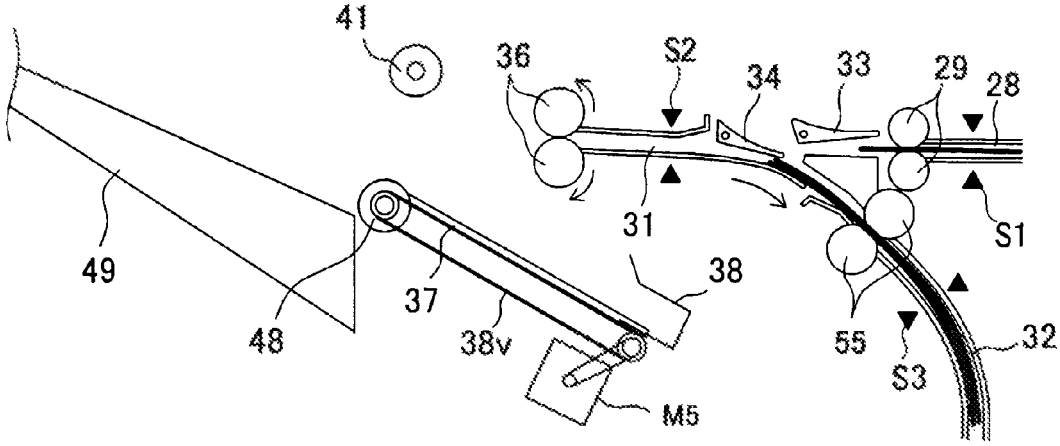

The MCU 98 further reversely drives the non-illustrated second conveying motor by a predetermined number of steps after the third sensor S3 detects the sheet leading ends and then stops it. As a result, the sheets (first and second sheets) are nipped by the conveying roller 55, and the sheet leading ends (rear ends in the conveying direction) are located at the second diverging point D2. Then, the MCU 98 waits until the first sensor S1 detects the leading end of the third sheet carried into the sheet carry-in path 28. FIG. 18B illustrates a state immediately after the third sheet is carried into the sheet carry-in path 28.

Figure 18C:
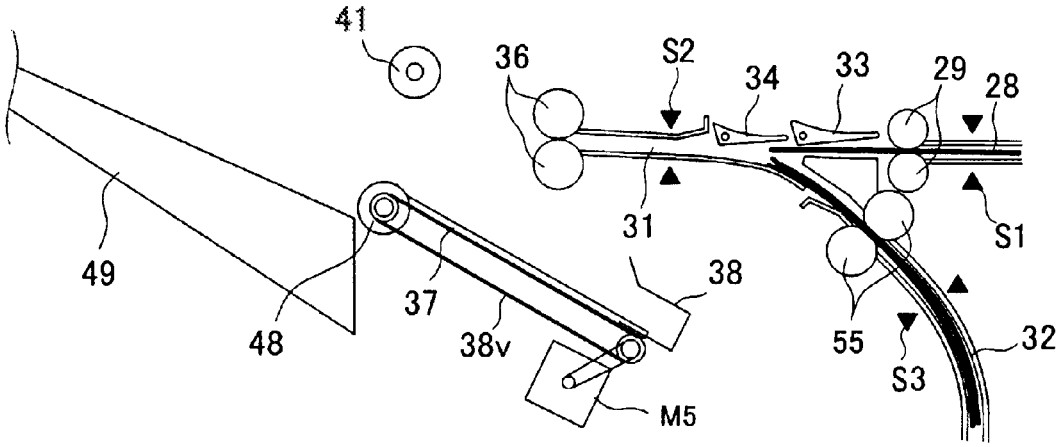

Then, when the first sensor S1 detects the leading end of the third sheet carried into the sheet carry-in path 28, the MCU 98 turns off the electromagnetic solenoid that drives the second flapper 34. As a result, the second flapper 34 is turned counterclockwise to the position illustrated in FIG. 5A. After the first sensor S1 detects the leading end of the third sheet carried into the sheet carry-in path 28, the MCU 98 normally drives the non-illustrated second conveying motor at a timing at which the leading end reaches the second diverging point D2. FIG. 18C illustrates a state immediately after the second conveying motor is normally driven and immediately before the leading end of the third sheet and those of the first and second sheets are aligned.

The first to third sheets are conveyed on the first conveying path 31 by the rotation of the carry-in roller 29 driven by the non-illustrated first conveying motor, and the normal rotation of the sheet discharge roller 36 and the conveying roller 55 normally driven by the non-illustrated second conveying motor with the leading ends thereof aligned. The MCU 98 repeats the above processing to align the leading ends of the fourth and fifth sheets constituting the first sheet set and, as in the first sheet set (2 sheets), discharges the second sheet set (5 sheets) onto the first sheet set (2 sheets) stacked on the first tray 49. Thereafter, like the above, the MCU 98 discharges the third sheet set (5 sheets) constituting the first sheet bundle onto the second sheet set (5 sheets) stacked on the first tray 49.

Thus, the first dividing processing executed by the MCU 98 is completed. Then, the MCU 98 determines whether or not there is a sheet bundle (second sheet bundle) to be processed next (S114). According to the above example, the number of sheet bundles is four, so that an affirmative result is made. When making the affirmative determination, the MCU 98 determines whether or not the sheet bundle to be processed next is the odd-numbered sheet bundle according to the determination processing of S104. In this determination, a negative determination is made since the sheet bundle to be processed next is the second (even-numbered) sheet bundle. When making a negative determination, the MCU 98 executes second dividing to form an even-numbered sheet bundle on the first tray 49 (S110).

(2) Second Dividing Processing

The second dividing processing differs from the first dividing processing in the following points: (A) three sets of 5 (sheets)-5 (sheets)-2 (sheets) are discharged onto the first tray 49 to form a sheet bundle; and (B) sheets constituting each even-numbered sheet bundle (e.g., second sheet bundle) is shifted by sheet set for jog sorting. Description of point (A) may overlap that of the first dividing processing and so will be omitted, and only the point B will be described below.

For example, the first sheet set (5 sheets) constituting the second sheet bundle is conveyed on the first conveying path 31 by the rotation of the carry-in roller 29 driven by the non-illustrated first conveying motor and the normal rotation of the sheet discharge roller 36 and the conveying roller 55 normally driven by the non-illustrated second conveying motor with the leading ends thereof aligned (see also FIG. 17A).

At the time when normally driving the non-illustrated second conveying motor by a predetermined number of steps according to the sheet size after the second sensor S2 detects the leading end of the first sheet set (5 sheets), the MCU 98 drives, e.g., normally by a predetermined of steps, the drive motor M6 (see FIG. 15) through the actuator controller 99 to shift the roller shaft of the sheet discharge roller 36, thereby shifting the first sheet set (five sheets) being conveyed (for example, in the example of FIG. 11, the first sheet set is shifted rightward in FIG. 15). This shift needs to be completed before the leading end of the first sheet set (5 sheets) is nipped between the lifting roller 41 and the driven roller 48, so that drive of the non-illustrated conveying motor may be temporarily stopped. That is, the drive of the non-illustrated second conveying motor is once stopped, then the first sheet set (5 sheets) is shifted in the stop state, and thereafter, the non-illustrated second conveying motor is normally rotated once again. Thereafter, after the first sheet set (5 sheets) is separated from the nip of the sheet discharge roller 36, the MCU 98 drives e.g., reversely, the drive motor M6 by a predetermined number of steps to set back the roller shaft of the sheet discharge roller 36 to the position before the shift.

In the above description, the first sheet set (5 sheets) constituting the second sheet bundle has been described. Thereafter, the MCU 98 executes the same shift processing for each sheet set constituting the even-numbered sheet bundle (according to the above example, second and third sheet sets constituting the second sheet bundle and first to third sheet sets constituting the fourth sheet bundle).

After completion of the second dividing processing, the MCU 98 determines whether or not there is a sheet bundle (third sheet bundle) to be processed next (S114). When making an affirmative determination, the MCU 98 determines whether or not the sheet bundle to be processed next is the odd-numbered sheet bundle (S104). When making an affirmative determination, the MCU 98 determines whether or not the current processing is processing for the first sheet bundle (S106). According to the above example, this is processing for the third sheet bundle, so that a negative determination is made here. When making the negative determination, the MCU 98 executes third dividing processing to form the third sheet bundle on the first tray 49 (S112).

(3) Third Dividing Processing

The third dividing processing differs from the first diving processing only in that three sets of 5 (sheets)-5 (sheets)-2 (sheets) are discharged onto the first tray 49 to form a sheet bundle, so that description of which may overlap that of the first dividing and so will be omitted.

After completion of the third dividing processing, the MCU 98 determines whether or not there is a sheet bundle (fourth sheet bundle) to be processed next (S114). When making an affirmative determination, the MCU 98 determines whether or not the sheet bundle to be processed next is the odd-numbered sheet bundle (S104). According to the above example, this is processing for the fourth sheet bundle (even-numbered sheet bundle), so that a negative determination is made here. The MCU 98 executes the second dividing processing so as to form the fourth sheet bundle on the first tray 49 (S110).

Third Embodiment

Next, a third embodiment of the image forming system to which the present invention can be applied will be described. The present embodiment is featured in that, in the jog sorting processing exemplified in the first embodiment, at least first sheet set constituting the first sheet bundle is discharged onto the first tray 49 through the first conveying path 31, and the subsequent sheet sets are discharged onto the first tray 49 through the processing tray 37. That is, the jog sorting processing of the present invention is achieved by a combination of straight discharge and buffer discharge by the processing tray 37.

<Operation>

It is assumed here that, as in the jog sorting processing of the first embodiment, the post-processing mode information is "jog sorting mode (the number of sheet bundles: 4, the number of sheets constituting one sheet bundle: 12)" and that the set number is 5 (sheets). The control operation of the MCU 98 in the present embodiment is clear from the description of the control operation of the MCU 98 in the first and second embodiments, so that description thereof will be omitted.

In the division number determination processing (see also S102 in FIG. 12), the number of sheets included in the first sheet set constituting the first sheet bundle is set to 1 (sheet). In the above example, four sets of 1 (sheet)-(sheets)-5 (sheets)-1 (sheet) are discharged onto the first tray 49.

That is, (a) the first sheet set (1 sheet) constituting the first sheet bundle is discharged onto the first tray 49 through the first conveying path 31, and (b) the second and subsequent sheet sets (5 sheets, 5 sheets and 1 sheet) constituting the first sheet bundle are each discharged onto the first tray 49 through the processing tray 37 having a buffer function of temporarily retaining the sheets as in the first embodiment.

Figure 19A:
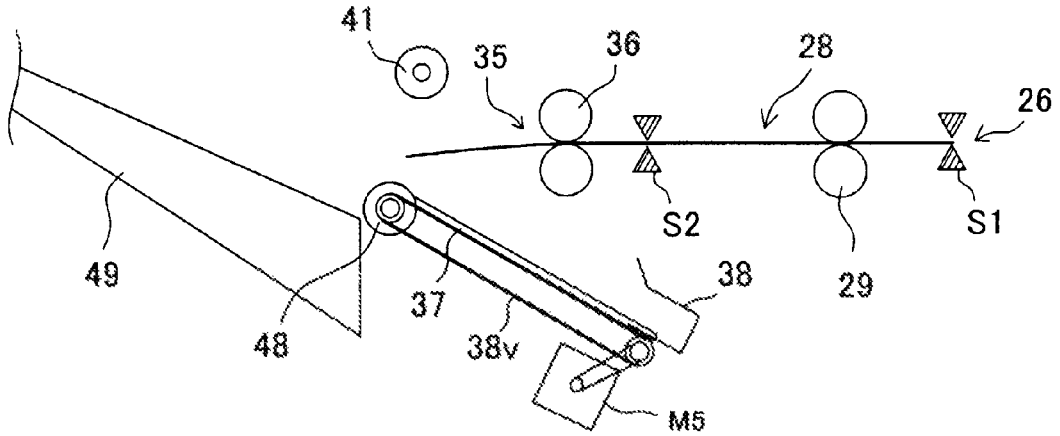
Figure 19B:
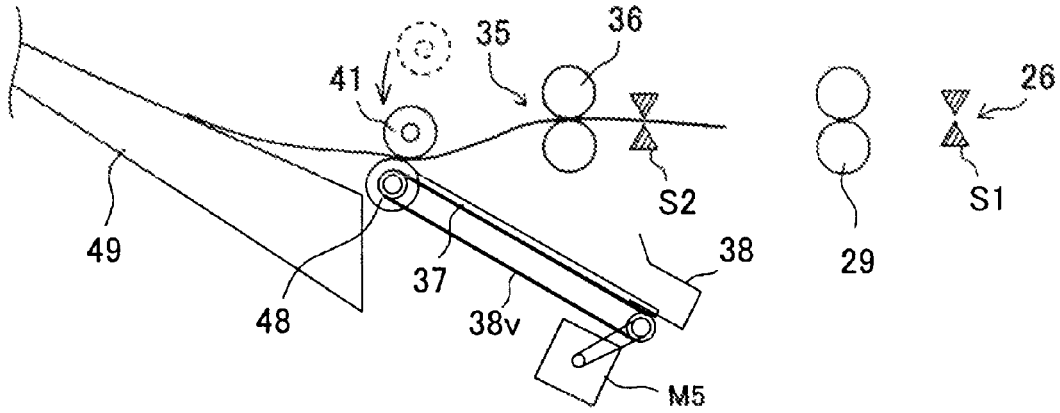
Figure 19C:
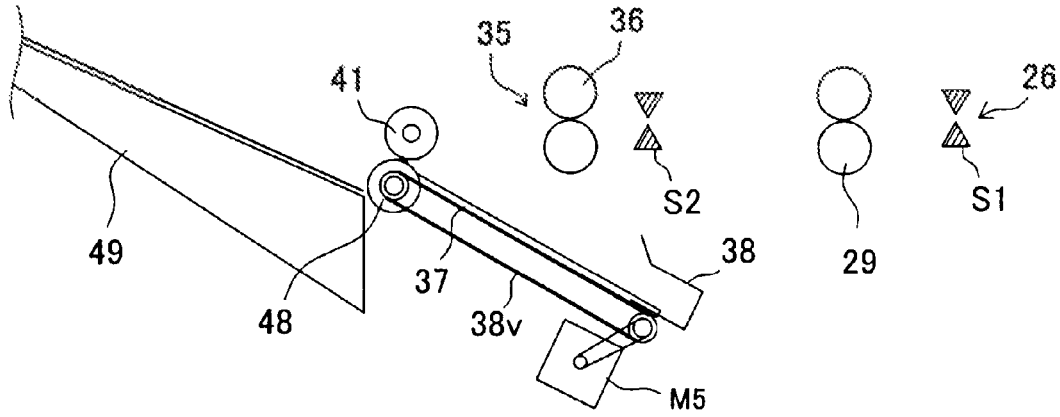

FIGS. 19A to 19C are explanatory views illustrating the operation of the above (a), i.e., discharge operation of the first sheet set (1 sheet) onto the first tray 49 through the first conveying path 31 when forming the first sheet bundle on the first tray 49.

Specifically, FIG. 19A illustrates a state where the leading end of the first sheet set runs out of the sheet discharge port 35. In this state, the lifting roller 41 is located at the standby position. FIG. 19B illustrates a state where the first sheet set is being conveyed (discharged) onto the first tray 49 by the lifting roller 41 located at the operating position and the sheet discharge roller 36. FIG. 19C illustrates a state where discharge of the first sheet set onto the first tray 49 is completed. Thereafter, the non-illustrated second conveying motor is stopped to stop the normal rotation of both the lifting roller 41 and the sheet discharge roller 36, and the lifting roller 41 is located at the standby position by the normal drive of the non-illustrated lifting motor.

Figure 20A:
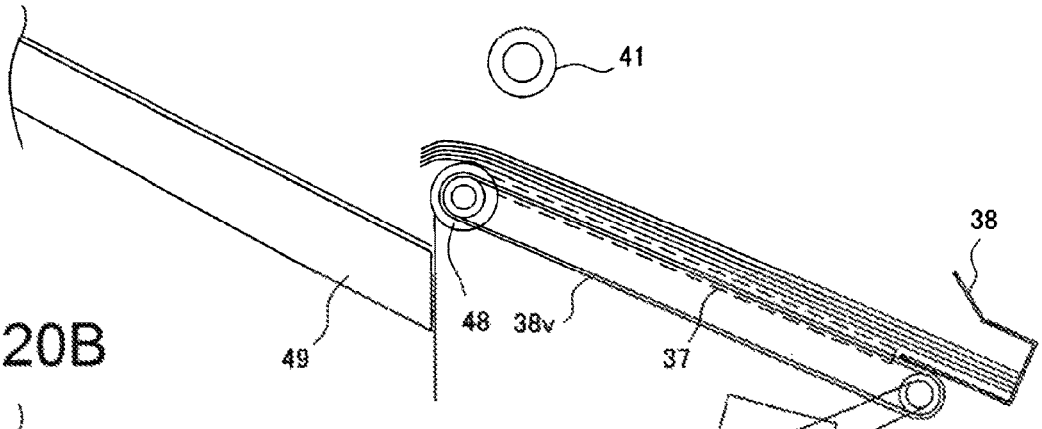
Figure 20B:
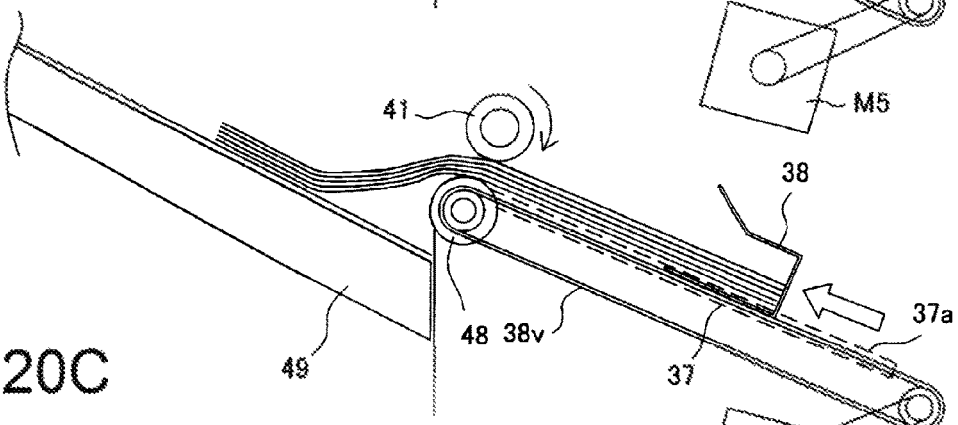
Figure 20C:
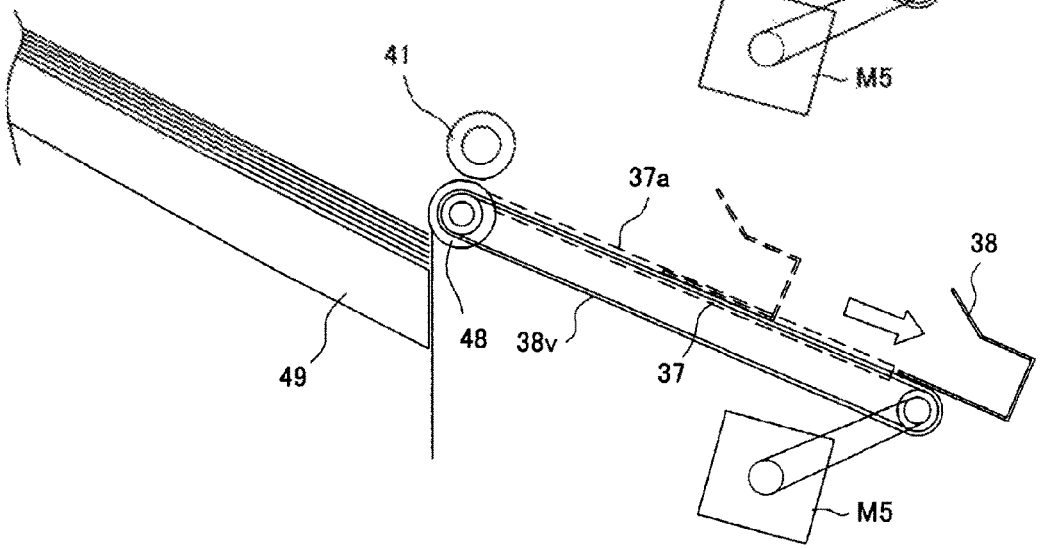

FIGS. 20A to 20C are explanatory views illustrating the operation of the above (b), i.e., discharge operation of the second sheet set (5 sheets) onto the first sheet set placed on the first tray 49 through the processing tray 37 when forming the first sheet bundle on the first tray 49.

More specifically, FIG. 20A illustrates a state immediately before the second sheet set is discharged, FIG. 20B illustrates a state where the second sheet set is being discharged, and FIG. 20C illustrates a state where discharge of the second sheet set is completed. That is, it can be understood that the third embodiment differs from the first embodiment only in that the number of sheets included in the first sheet set is 1 (sheet) (in FIGS. 14A to 14C of the first embodiment ((3-2) in 2. Jog Sorting Processing), the number of sheets included in the first set is 2 (sheet)).

In the above example, the sheets constituting the first sheet bundle are divided into four sheet sets (1 sheet-5 sheets-5 sheets-1 sheet) in order to enhance aligning property of the first sheet bundle; alternatively, in order to enhance processing speed, the sheets constituting the first sheet bundle may be divided such that 1 sheet-1 sheet-5 sheets-5 sheets and discharged in this order. In this case, the first sheet set (1 sheet) and the second sheet set (1 sheet) are discharged onto the first tray 49 through the first conveying path 31, and the third sheet set (5 sheets) and the fourth sheet set (5 sheets) are discharged onto the first tray 49 through the processing tray 37.

(Effects)

Effects of the image forming system according to the above embodiments will be described, mainly focusing on effects of the sheet post-processing device B.

In the sheet post-processing device B according to the embodiments, when forming the first sheet bundle on the first tray 49, sheets constituting the first sheet bundle are divided into a plurality of sets and discharged a plurality of times for each set. At this time, the number of sheets included in a sheet set to be discharged at the first time is smaller than the maximum number of sheets included in sheet sets to be discharged at the second and subsequent times. Thus, in the conventional technology, the lowermost sheet constituting the first sheet bundle that directly contacts the surface of the first tray 49 may be displaced in position from other sheets due to the difference in friction coefficient between the surface of the first tray 49 and the sheet. However, the sheet post-processing device B according to the above embodiments can prevent such displacement.

Further, in the sheet post-processing device B according to the second embodiment, the sheet conveying paths (first conveying path 31, the sheet carry-in path 28, and the second conveying path 32) are used to form a sheet bundle on the first tray 49. Thus, as compared with the first embodiment, a smaller torque motor can be used (for, e.g., the non-illustrated second conveying motor). Further, the processing tray 37 is not necessarily required, thereby consolidating the sheet carry-in mechanism into the lifting roller 41 and the driven roller 48. This can enhance flexibility of layout of the sheet conveying paths.

In the above embodiments, a configuration in which the sheet bundle is formed on the first tray 49 in the jog sorting processing has been described; however, this can be applied not only to the case of the jog sorting processing, but also to the case of forming sheet bundles (including a case of forming only one sheet bundle). Further, the aligning members 39F and 39R exemplified in the first embodiment can be moved both leftward and rightward in FIG. 6 by a specified moving amount, and the sheet discharge roller 36 constituting the shift mechanism exemplified in the second embodiment can be shifted, together with the roller shaft thereof, both leftward and rightward in FIG. 15 by a specified moving amount, so that it is possible to perform sort processing of stacking three or more sheet bundles on the first tray 49 such that they are offset to one another.

Further, in the above embodiments, the sheet bundles are formed on the first tray 49 (discharge tray). However, the present invention is not limited to this, but the sheet bundle may be formed on a processing tray provided inside the device. In this case, to prevent an increase in the number of the processing trays, a diverging path from the sheet carry-in path 28 may be used as the buffer for temporarily retaining the sheet set, like the second conveying path 32 described in the second embodiment.

The configurations using such a diverging path may be as follows: 1) as described in the second embodiment, a sheet conveyed to a diverging path (second conveying path) through a conveying path (sheet carry-in path 28) is switchback conveyed in the direction opposite to the conveying direction of the sheet and is then discharged onto the first tray 49 through the conveying path (sheet carry-in path 28); 2) the above second diverging point D2 is located at the third diverging point D3 (see also FIG. 4), and a sheet conveyed to the diverging path is switchback conveyed in the direction opposite to the conveying direction of the sheet to be discharged onto the first tray 49; and 3) the diverging path from the diverging point D2 is inclined to the processing tray 37, and a sheet conveyed to the diverging path through the conveying path is discharged directly along the conveying direction of the sheet onto the processing tray 37. In the third configuration, for smooth discharge of a sheet from the diverging path to the processing tray 37 and of a sheet or a sheet bundle from the processing tray 37 to the first tray 49, an angle change mechanism for changing the installation angle of, e.g., the processing tray 37 may be provided.

Further, in the second embodiment, the layout flexibility of the sheet conveying paths can be enhanced as described above; however, when the processing tray 37 is not provided, stapling by the stapler unit 47 cannot be performed, so that, in this case, sheets are conveyed to the second conveying path 32, and the corner portion (rear end portion) of a sheet bundle is stapled by the saddle-stitching unit 63.

Further, in the first embodiment, sheets included in the sheet set constituting an even-numbered sheet bundle are shifted one by one by the aligning members 39F and 39R; alternatively, however, the sheets included in the sheet set constituting the even-numbered sheet bundle may previously be aligned with respect to, e.g., the center and shifted at a time by the aligning members 39F and 39R before being conveyed onto the first tray 49.

When the aligning members can be moved only in one direction (while in the first embodiment, aligning members 39F and 39R can be moved both leftward and rightward) or do not have the shift mechanism (exemplified in the second embodiment), the stack tray may be moved in the direction perpendicular to the conveying direction for jog sorting or sorting.

This application is based upon and claims the benefit of priority from prior Japanese Patent Applications No. 2015-251293, the entire contents of which are incorporated herein by reference.

What is claimed is:

1. A sheet discharge apparatus comprising:

a first tray for stacking sheets; and a sheet bundle forming unit that forms a sheet bundle on the first tray, wherein the sheet bundle forming unit forms a first sheet bundle on the first tray, and forms a second sheet bundle stacked on the first sheet bundle in a state wherein the second sheet bundle is offset from the first sheet bundle, the second sheet bundle having a number of sheets that is a same number of the first sheet bundle, when forming each of the first sheet bundle and the second sheet bundle on the first tray, the sheet bundle forming unit divides sheets constituting each of the sheet bundles into a plurality of sets and discharges each of the plurality of sets of sheets individually for each sheet bundle, and one or more sheets included in a first sheet set of the first sheet bundle to be discharged at a first time is set smaller than a number of sheets included in a first sheet set of the second sheet bundle to be discharged at a first time.

2. The sheet discharge apparatus according to claim 1, wherein the sheet bundle forming unit has a buffer part that temporarily retains conveyed sheets until the number of the conveyed sheets reaches a predetermined number, and a discharge mechanism that discharges the sheets retained in the buffer part onto the first tray.

3. The sheet discharge apparatus according to claim 2, further comprising a conveying path for sheet conveyance, wherein the buffer part is a second tray for temporarily stacking a sheet conveyed thereto through the conveying path.

4. The sheet discharge apparatus according to claim 2, further comprising a conveying path for sheet conveyance, wherein the buffer part is a diverging path formed so as to diverge from the conveying path.

5. The sheet discharge apparatus according to claim 2, further comprising a conveying path for sheet conveyance, wherein the buffer part is a second tray for temporarily stacking a sheet conveyed thereto through the conveying path, and the discharge mechanism discharges a first sheet of the first sheet bundle conveyed thereto through the conveying path onto the first tray as a sheet divided and discharged for a first time, and discharges a sheet temporarily stacked on the second tray onto the first tray as a second or subsequent sheet.

6. The sheet discharge apparatus according to claim 1, wherein the plurality of sets forming each of the sheet bundles is stacked to be aligned together.

7. An image forming system comprising:

an image forming unit that forms an image onto a sheet;

a first tray for stacking a sheet on which an image is formed by the image forming unit; and a sheet bundle forming unit that forms a sheet bundle on the first tray, wherein the sheet bundle forming unit forms a first sheet bundle on the first tray, and forms a second sheet bundle stacked on the first sheet bundle in a state wherein the second sheet bundle is offset from the first sheet bundle, the second sheet bundle having a number of sheets that is a same number of the first sheet bundle, when forming each of the first sheet bundle and the second sheet bundle on the first tray, the sheet bundle forming unit divides sheets constituting each of the sheet bundles into a plurality of sets and discharges each of the plurality of sets of sheets individually for each sheet bundle, and one or more sheets included in a first sheet set of the first sheet bundle to be discharged at a first time is set smaller than a number of sheets included in a first sheet set of the second sheet bundle to be discharged at a first time.

* * * * *